US009026025B2

(12) United States Patent
Mimbu et al.

(10) Patent No.: US 9,026,025 B2
(45) Date of Patent: May 5, 2015

(54) FIXING DEVICE INCLUDING HEATING SPAN ADJUSTER, IMAGE FORMING APPARATUS, AND FIXING METHOD

(71) Applicants: Ryuuichi Mimbu, Kanagawa (JP); Masaaki Yoshikawa, Tokyo (JP); Takayuki Seki, Kanagawa (JP); Takeshi Yamamoto, Kanagawa (JP); Yutaka Ikebuchi, Kanagawa (JP); Takuya Seshita, Kanagawa (JP); Shuntaro Tamaki, Kanagawa (JP); Hajime Gotoh, Kanagawa (JP); Takahiro Imada, Kanagawa (JP); Kazuya Saito, Kanagawa (JP); Toshihiko Shimokawa, Kanagawa (JP); Shuutaroh Yuasa, Kanagawa (JP); Kensuke Yamaji, Kanagawa (JP); Akira Suzuki, Tokyo (JP); Hiroshi Yoshinaga, Chiba (JP); Yuji Arai, Kanagawa (JP)

(72) Inventors: Ryuuichi Mimbu, Kanagawa (JP); Masaaki Yoshikawa, Tokyo (JP); Takayuki Seki, Kanagawa (JP); Takeshi Yamamoto, Kanagawa (JP); Yutaka Ikebuchi, Kanagawa (JP); Takuya Seshita, Kanagawa (JP); Shuntaro Tamaki, Kanagawa (JP); Hajime Gotoh, Kanagawa (JP); Takahiro Imada, Kanagawa (JP); Kazuya Saito, Kanagawa (JP); Toshihiko Shimokawa, Kanagawa (JP); Shuutaroh Yuasa, Kanagawa (JP); Kensuke Yamaji, Kanagawa (JP); Akira Suzuki, Tokyo (JP); Hiroshi Yoshinaga, Chiba (JP); Yuji Arai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/269,314

(22) Filed: May 5, 2014

(65) Prior Publication Data

US 2014/0341626 A1 Nov. 20, 2014

(30) Foreign Application Priority Data

May 16, 2013 (JP) ..... 2013-104181

(51) Int. Cl.
*G03G 15/20* (2006.01)

(52) U.S. Cl.
CPC ..... *G03G 15/2032* (2013.01); *G03G 15/2017* (2013.01); *G03G 15/2042* (2013.01)

(58) Field of Classification Search
CPC ..... G03G 15/2017; G03G 15/2042; G03G 15/2046; G03G 15/2053
USPC ..... 399/45, 67, 69, 328, 329, 334
See application file for complete search history.

(56) References Cited

U.S. PATENT DOCUMENTS

| | | | | |
|---|---|---|---|---|
| 8,351,807 | B2 * | 1/2013 | Seki | 399/45 |
| 8,588,670 | B2 * | 11/2013 | Shimokawa et al. | 399/334 |
| 2005/0191098 | A1 | 9/2005 | Ueno et al. | |
| 2007/0264060 | A1 | 11/2007 | Ueno et al. | |
| 2007/0292175 | A1 | 12/2007 | Shinshi | |
| 2014/0079453 | A1 | 3/2014 | Arai et al. | |

FOREIGN PATENT DOCUMENTS

| | | |
|---|---|---|
| JP | 4-044083 | 2/1992 |
| JP | 11-344902 | 12/1999 |
| JP | 2004-286922 | 10/2004 |
| JP | 2005-258383 | 9/2005 |
| JP | 2006-243288 | 9/2006 |
| JP | 2007-334205 | 12/2007 |
| JP | 2009-258203 | 11/2009 |
| JP | 2011-047995 | 3/2011 |

* cited by examiner

*Primary Examiner* — William J Royer
(74) *Attorney, Agent, or Firm* — Oblon, McClelland, Maier & Neustadt, L.L.P.

(57) ABSTRACT

A fixing device includes a fixing rotator heated by a heater and a pressing rotator to press against the fixing rotator to form a fixing nip therebetween. A heating span adjuster, interposed between the heater and the fixing rotator, is movable in a circumferential direction of the fixing rotator. The heating span adjuster moves to a retracted position where the heating span adjuster allows the heater to heat the fixing rotator in an increased axial heating span of the fixing rotator after the heater starts heating the fixing rotator until the fixing rotator and the pressing rotator start conveying a recording medium through the fixing nip. The heating span adjuster at the retracted position is outboard from a circumferential, direct heating span of the fixing rotator where the heater heats the fixing rotator directly.

14 Claims, 9 Drawing Sheets

| | HEATER PAIR | | | |
|---|---|---|---|---|
| RECORDING MEDIUM | CENTER HEATER | LATERAL END HEATER | SHIELDING | RECORDING MEDIUM SIZE |
| A | ON | ON | NO | A3 EXTENSION |
| B | ON | ON | YES | A3 PORTRAIT<br>A4 LANDSCAPE |
| C | ON | OFF | NO | A4 PORTRAIT |
| D | ON | OFF | YES | POSTCARD |

FIXING DEVICE INCLUDING HEATING SPAN ADJUSTER, IMAGE FORMING APPARATUS, AND FIXING METHOD

CROSS-REFERENCE TO RELATED APPLICATION

This patent application is based on and claims priority pursuant to 35 U.S.C. §119 to Japanese Patent Application No. 2013-104181, filed on May 16, 2013, in the Japanese Patent Office, the entire disclosure of which is hereby incorporated by reference herein.

BACKGROUND

1. Technical Field

Exemplary aspects of the present invention relate to a fixing device, an image forming apparatus, and a fixing method, and more particularly, to a fixing device for fixing an image on a recording medium, an image forming apparatus incorporating the fixing device, and a fixing method for fixing a toner image on a recording medium.

2. Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

The fixing device may employ an endless belt or an endless film to heat the recording medium. For example, the fixing device may include an endless belt and a pressure roller pressed against the belt to form a fixing nip therebetween. As a recording medium bearing a toner image is conveyed through the fixing nip, the belt and the pressure roller apply heat and pressure to the recording medium, melting and fixing the toner image on the recording medium. The belt is requested to be heated quickly to shorten a first print time taken to output the recording medium bearing the fixed toner image upon receipt of a print job. Additionally, as the image forming apparatus conveys an increased amount of recording media at high speed, the belt is requested to overcome shortage of heat.

In order to shorten the first print time, the fixing device may include an endless film and a pressure roller pressed against a ceramic heater disposed inside the film to form a fixing nip between the film and the pressure roller. As a recording medium bearing a toner image is conveyed through the fixing nip, the film heated by the ceramic heater and the pressure roller fix the toner image on the recording medium under heat and pressure. Since the film is heated by the heater situated at the fixing nip, the film is heated insufficiently at an entry to the fixing nip, resulting in faulty fixing. Accordingly, the film is requested to overcome shortage of heat at the entry to the fixing nip.

To address those requests, the fixing device may employ a tubular, metal thermal conductor disposed inside the belt. The pressure roller is pressed against the metal thermal conductor via the belt to form a fixing nip between the belt and the pressure roller. A heater situated inside the metal thermal conductor heats the metal thermal conductor which in turn heats the belt. As a recording medium bearing a toner image is conveyed through the fixing nip, the belt heated by the metal thermal conductor and the pressure roller apply heat and pressure to the recording medium, fixing the toner image on the recording medium. Since the tubular, metal thermal conductor is disposed opposite the belt throughout the entire circumferential span thereof, the metal thermal conductor heats the belt quickly, thus shortening the first print time and overcoming shortage of heat.

In order to shorten the first print time and save energy further, the belt heated by the heater directly, not through the metal thermal conductor, is proposed. For example, the fixing device may include the belt and a light emitter situated inside the belt. The light emitter emits light onto the belt in a first span in a direction perpendicular to a conveyance direction of the recording medium conveyed over the belt and a second span in the conveyance direction of the recording medium. A light shield produced with a recess through which light from the light emitter travels to the belt is interposed between the light emitter and the belt. A motor moves the light shield in the conveyance direction of the recording medium. A width of the recess in the direction perpendicular to the conveyance direction of the recording medium is within the first span of the belt and variable depending on the position of the recording medium in the conveyance direction thereof.

The light emitter irradiates the belt through the recess having a first heating span corresponding to a first width of a recording medium and a second heating span corresponding to a second width of a recording medium. Since the light shield shields light from the light emitter at a portion other than the recess, the belt is heated in a span corresponding to the first heating span or the second heating span of the recess. As the motor moves the light shield in the conveyance direction of the recording medium, the span of the recess of the light shield changes within the first span of the belt as the recording medium moves in the conveyance direction thereof.

During a fixing job, the light shield shields the belt from the light emitter in a non-conveyance span of the belt where the recording medium is not conveyed, preventing overheating of the non-conveyance span of the belt. However, since the light shield shields the non-conveyance span of the belt from the light emitter, while the fixing device is warmed up from an ambient temperature to a predetermined temperature as the fixing device is powered on, the light shield may render the light emitter to heat the belt unevenly. Accordingly, during a next fixing job, uneven temperature of the belt may cause variation in gloss of the toner image fixed on the recording medium depending on the size of the recording medium used in the next fixing job. Additionally, the light shield shielding the non-conveyance span of the belt may save energy insufficiently and lengthen the first print time.

SUMMARY

This specification describes below an improved fixing device. In one exemplary embodiment, the fixing device includes a fixing rotator rotatable in a predetermined direction of rotation and a heater disposed opposite the fixing rotator to heat the fixing rotator. A pressing rotator presses against the fixing rotator to form a fixing nip therebetween, through which a recording medium is conveyed. A heating span adjuster is interposed between the heater and the fixing rotator and movable in a circumferential direction of the fixing rotator to change an axial heating span of the fixing rotator where the heater heats the fixing rotator. The heating span adjuster moves to a retracted position where the heating span adjuster allows the heater to heat the fixing rotator in an increased axial heating span of the fixing rotator after the heater starts heating the fixing rotator until the fixing rotator and the pressing rotator start conveying the recording medium through the fixing nip. The heating span adjuster at the retracted position is outboard from a circumferential, direct heating span of the fixing rotator where the heater heats the fixing rotator directly.

This specification further describes an improved image forming apparatus. In one exemplary embodiment, the image forming apparatus includes an image forming device to form a toner image and a fixing device to fix the toner image formed by the image forming device on a recording medium. The fixing device includes a fixing rotator rotatable in a predetermined direction of rotation and a heater disposed opposite the fixing rotator to heat the fixing rotator. A pressing rotator presses against the fixing rotator to form a fixing nip therebetween, through which a recording medium is conveyed. A heating span adjuster is interposed between the heater and the fixing rotator and movable in a circumferential direction of the fixing rotator to change an axial heating span of the fixing rotator where the heater heats the fixing rotator. A controller is operatively connected to the heating span adjuster to move the heating span adjuster to a retracted position where the heating span adjuster allows the heater to heat the fixing rotator in an increased axial heating span of the fixing rotator after the heater starts heating the fixing rotator until the fixing rotator and the pressing rotator start conveying the recording medium through the fixing nip. The heating span adjuster at the retracted position is outboard from a circumferential, direct heating span of the fixing rotator where the heater heats the fixing rotator directly.

This specification further describes an improved fixing method for fixing a toner image on a recording medium conveyed through a fixing nip formed between a fixing rotator and a pressing rotator. In one exemplary embodiment, the fixing method includes receiving a fixing job; starting heating the fixing rotator with a heater; moving a heating span adjuster to a retracted position where the heating span adjuster allows the heater to heat the fixing rotator in an increased axial heating span of the fixing rotator; detecting a temperature of at least one of the pressing rotator and the fixing rotator; determining that the detected temperature is not lower than a preset conveyance temperature; determining to allow conveyance of the recording medium through the fixing nip; detecting a size of the recording medium; moving the heating span adjuster to a predetermined position corresponding to the detected size of the recording medium; and starting conveying the recording medium through the fixing nip.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
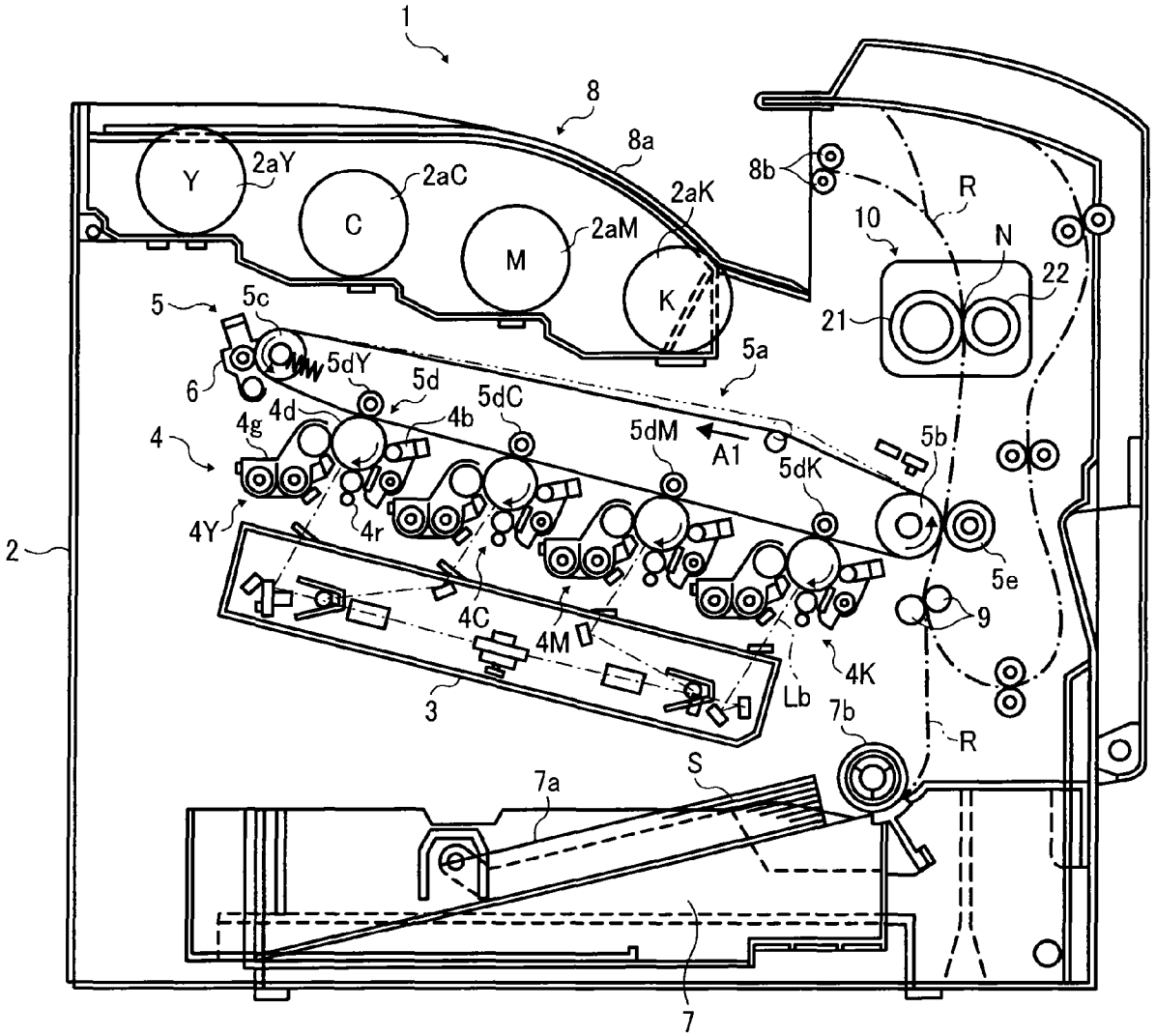
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color printer that forms color and monochrome toner images on recording media by electrophotography.

As shown in FIG. 1, the image forming apparatus 1 includes a body 2 accommodating an optical writer 3, a process unit 4, a transfer device 5, a belt cleaner 6, a recording medium feeder 7, a registration roller pair 9, and a fixing device 10. The image forming apparatus 1 further includes an output device 8 disposed atop the body 2.

The image forming apparatus 1 has a tandem structure in which four photoconductive drums 4*d* serving as image carriers for bearing yellow, cyan, magenta, and black toner images are aligned in tandem. Alternatively, the image forming apparatus 1 may have a structure other than the tandem structure.

The body 2 is a cabinet accommodating various components. For example, the cabinet accommodates a conveyance path R through which a recording medium S (e.g., a sheet) is conveyed from the recording medium feeder 7 to the output device 8. Below the output device 8 are toner bottles 2*a*Y, 2*a*C, 2*a*M, and 2*a*K detachably attached to the body 2 and containing fresh yellow, cyan, magenta, and black toners, respectively. The body 2 further accommodates a waste toner container having an inlet in communication with a waste toner conveyance tube through which waste toner collected from the process unit 4 and the transfer device 5 is conveyed to the waste toner container.

A detailed description is now given of a construction of the optical writer 3.

The optical writer 3 includes a semiconductor laser serving as a light source, a coupling lens, an f-θ lens, a troidal lens, a deflection mirror, and a polygon mirror. The optical writer 3 emits a laser beam Lb onto the respective photoconductive drums 4*d* of the process unit 4 according to yellow, cyan, magenta, and black image data separated from color image data sent from an external device such as a client computer, forming electrostatic latent images on the photoconductive drums 4*d*, respectively.

A detailed description is now given of a construction of the process unit 4.

The process unit 4 includes four sub process units 4Y, 4C, 4M, and 4K serving as image forming devices that form yellow, cyan, magenta, and black toner images, respectively. Taking the sub process unit 4Y for forming a yellow toner image, for example, the sub process unit 4Y includes the photoconductive drum 4*d*, a charging roller 4*r*, a development device 4*g*, and a cleaning blade 4*b*. The charging roller 4*r*, the optical writer 3, the development device 4*g*, the transfer device 5, and the cleaning blade 4*b* surround the photoconductive drum 4*d* such that charging, optical writing, developing, transfer, cleaning, and discharging processes are performed on the photoconductive drum 4*d* in this order.

For example, the charging roller 4*r* charges an outer circumferential surface of the photoconductive drum 4*d* electrostatically. The optical writer 3 conducts optical writing on the charged outer circumferential surface of the photoconductive drum 4*d*, forming an electrostatic latent image formed of electrostatic patterns on the photoconductive drum 4*d*. The development device 4*g* adheres yellow toner supplied from the toner bottle 2*a*Y to the electrostatic latent image formed on the photoconductive drum 4*d*, thus visualizing the electrostatic latent image into a yellow toner image. The yellow toner image is primarily transferred onto the transfer device 5. The cleaning blade 4*b* removes residual toner failed to be transferred onto the transfer device 5 and therefore remaining on the photoconductive drum 4*d* therefrom, rendering the photoconductive drum 4*d* to be ready for a next primary transfer. Thereafter, the discharging process to remove residual static electricity from the photoconductive drum 4*d* is performed on the photoconductive drum 4*d*.

The photoconductive drum 4*d* is a tube including a surface photoconductive layer made of organic and inorganic photoconductors. The charging roller 4*r* is located in proximity to the photoconductive drum 4*d* to charge the photoconductive drum 4*d* with discharge between the charging roller 4*r* and the photoconductive drum 4*d*.

The development device 4*g* is constructed of a supply section for supplying yellow toner to the photoconductive drum 4*d* and a development section for adhering yellow toner to the photoconductive drum 4*d*. The cleaning blade 4*b* includes an elastic band made of rubber and a toner remover such as a brush. The development device 4*g* is detachably attached to the body 2.

Each of the sub process units 4C, 4M, and 4K has a construction equivalent to that of the sub process unit 4Y described above. The sub process units 4C, 4M, and 4K form cyan, magenta, and black toner images to be primarily transferred onto the transfer device 5, respectively.

A detailed description is now given of a construction of the transfer device 5.

The transfer device 5 includes a transfer belt 5*a*, a driving roller 5*b*, a driven roller 5*c*, four primary transfer rollers 5*d*, and a secondary transfer roller 5*e*. The transfer belt 5*a* is an endless belt stretched taut across the driving roller 5*b* and the driven roller 5*c*. As the driving roller 5*b* rotating counterclockwise in FIG. 1 drives and rotates the transfer belt 5*a* in a rotation direction A1, the driven roller 5*c* is rotated counterclockwise in FIG. 1 by friction between the driven roller 5*c* and the transfer belt 5*a*.

The primary transfer rollers 5*d* include primary transfer rollers 5*d*Y, 5*d*C, 5*d*M, and 5*d*K pressed against the photoconductive drums 4*d* of the sub process units 4Y, 4C, 4M, and 4K via the transfer belt 5*a*, respectively. Thus, the transfer belt 5*a* contacts the sub process units 4Y, 4C, 4M, and 4K, forming four primary transfer nips between the transfer belt 5*a* and the sub process units 4Y, 4C, 4M, and 4K, respectively. As the secondary transfer roller 5*e* pressingly contacting an outer circumferential surface of the transfer belt 5*a* is pressed against the driving roller 5*b* via the transfer belt 5*a*, a secondary transfer nip is formed between the secondary transfer roller 5*e* and the transfer belt 5*a*. As a recording medium S is conveyed through the secondary transfer nip, the yellow, cyan, magenta, and black toner images carried on the transfer belt 5*a* are secondarily transferred onto the recording medium S.

A detailed description is now given of a construction of the belt cleaner 6.

The belt cleaner 6 is situated between the secondary transfer nip and the sub process unit 4Y in the rotation direction A1 of the transfer belt 5*a*. The belt cleaner 6 includes a toner remover and the toner conveyance tube. The toner remover removes residual toner failed to be transferred onto the recording medium S and therefore remaining on the outer circumferential surface of the transfer belt 5*a* therefrom. The toner conveyance tube conveys the removed toner to the waste toner container as waste toner.

A detailed description is now given of a construction of the recording medium feeder 7.

The recording medium feeder 7, located in a lower portion of the body 2, includes a paper tray 7*a* that loads a plurality of recording media S and a feed roller 7*b* that picks up and feeds a recording medium S from the paper tray 7*a*. The feed roller 7*b* picks up an uppermost recording medium S from the plurality of recording media S loaded on the paper tray 7*a* and feeds the uppermost recording medium S to the conveyance path R.

A detailed description is now given of a construction of the output device 8.

The output device 8, disposed above the optical writer 3 and atop the body 2, includes an output tray 8*a* and an output roller pair 8*b* that feeds the recording medium S onto the output tray 8*a* that receives the recording medium S. The recording media S discharged from the conveyance path R by the output roller pair 8*b* are stacked on the output tray 8*a* one by one such that the recording media S are layered successively on the output tray 8*a*.

A detailed description is now given of a configuration of the registration roller pair 9.

The registration roller pair 9 adjusts conveyance of the recording medium S conveyed through the conveyance path R by the feed roller 7*b* of the recording medium feeder 7. For example, a registration sensor, located inside the body 2 at a position interposed between the feed roller 7*b* and the registration roller pair 9 in the conveyance path R, detects a leading edge of the recording medium S. When a predetermined time elapses after the registration sensor detects the leading edge of the recording medium S, the registration roller pair 9 interrupts rotation to temporarily halt the recording medium S that comes into contact with the registration roller pair 9. Thereafter, the registration roller pair 9 resumes rotation as it sandwiches the recording medium S at a predetermined time to convey the recording medium S to the secondary transfer nip. For example, the predetermined time is a time when the color toner image formed of the yellow, cyan, magenta, and black toner images superimposed on the transfer belt 5*a* reaches the secondary transfer nip as the transfer belt 5*a* rotates in the rotation direction A1.

Figure 2:
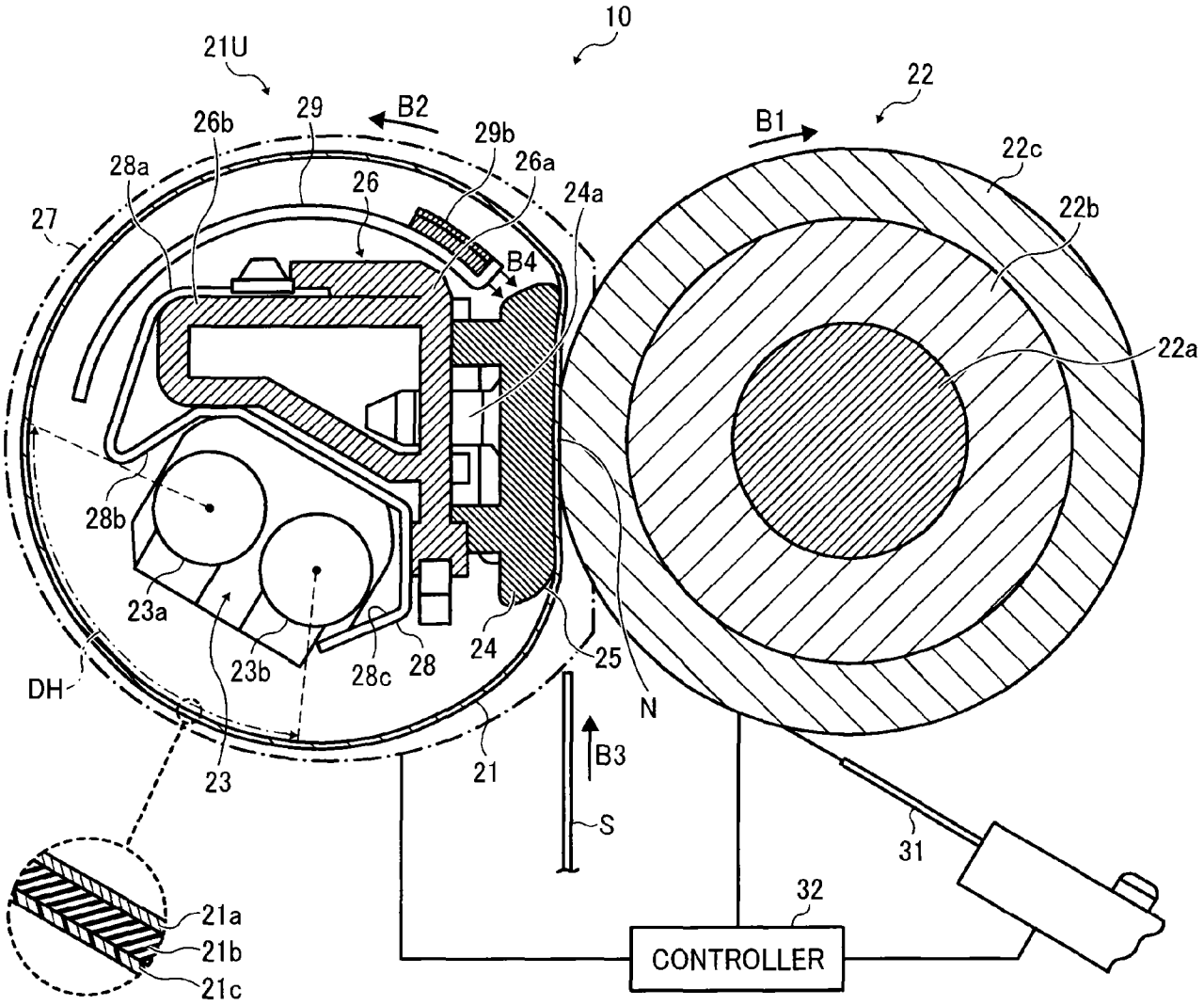
FIG. 2 is a vertical sectional view of a fixing device incorporated in the image forming apparatus shown in FIG. 1.
Figure 3:
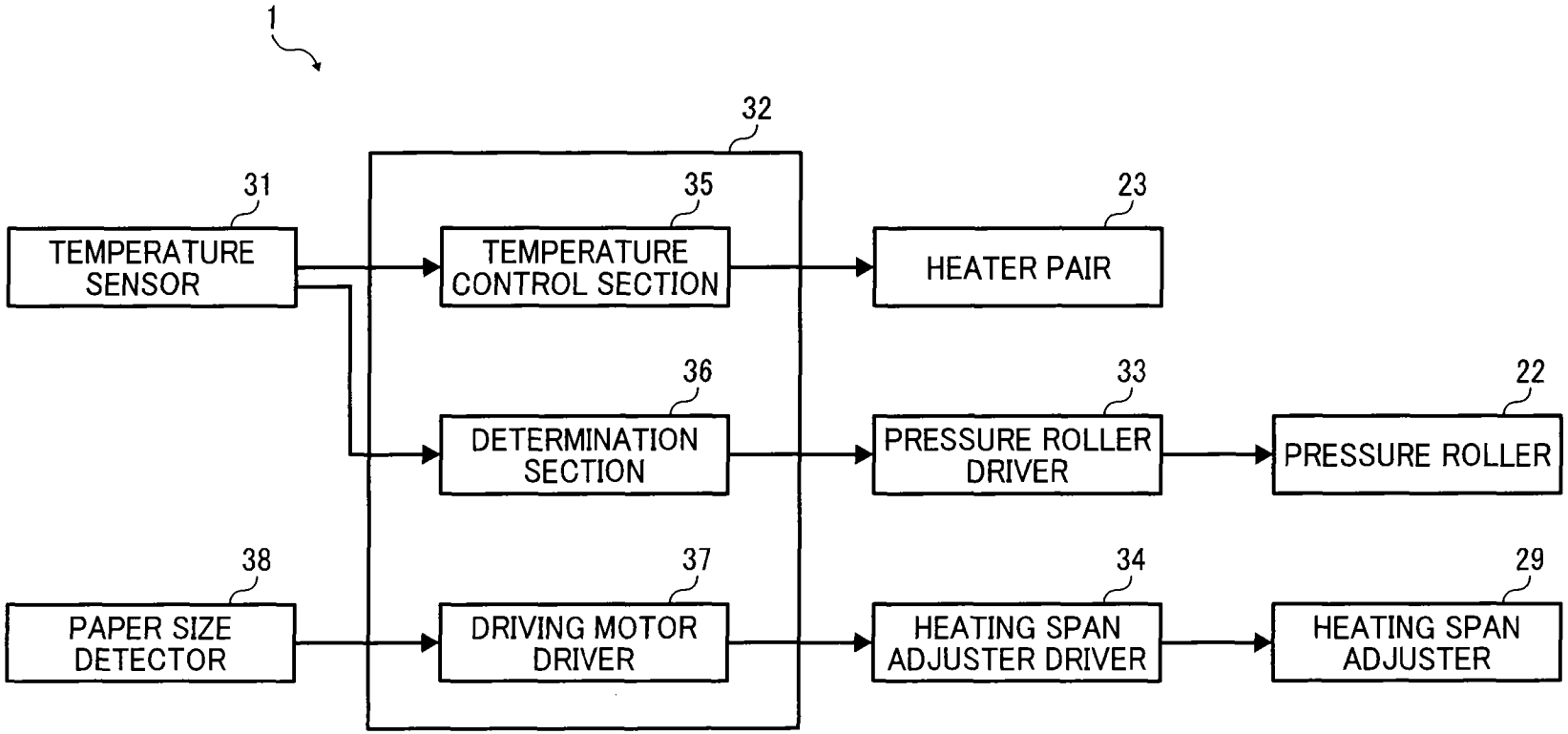
FIG. 3 is a block diagram of the image forming apparatus shown in FIG. 1.

With reference to FIGS. 2 and 3, a description is provided of a construction of the fixing device 10 incorporated in the image forming apparatus 1 described above.

FIG. 2 is a vertical sectional view of the fixing device 10. FIG. 3 is a block diagram of the image forming apparatus 1. As shown in FIG. 2, the fixing device 10 (e.g., a fuser) includes a fixing belt 21 serving as a fixing rotator or an endless belt formed into a loop and rotatable in a rotation direction B2; a pressure roller 22 serving as a pressing rotator disposed opposite an outer circumferential surface of the fixing belt 21 to separably or inseparably contact the fixing belt 21 and rotatable in a rotation direction B1 counter to the rotation direction B2 of the fixing belt 21; a heater pair 23 serving as a heater disposed inside the loop formed by the fixing belt 21 to heat the fixing belt 21; a nip formation pad 24 disposed inside the loop formed by the fixing belt 21 and pressing against the pressure roller 22 via the fixing belt 21 to form a fixing nip N between the fixing belt 21 and the pressure roller 22; a slide member 25 over which the fixing belt 21 slides; a support 26 disposed inside the loop formed by the fixing belt 21 to support the nip formation pad 24; a holder 27 to support the fixing belt 21; a reflector 28 disposed inside the loop formed by the fixing belt 21 to reflect light radiated from the heater pair 23 thereto toward the fixing belt 21; a heating span adjuster 29 interposed between the heater pair 23 and the fixing belt 21 to shield the fixing belt 21 from light radiated from the heater pair 23; and a temperature sensor 31 serving as a temperature detector disposed opposite an outer circumferential surface of the pressure roller 22 to detect the temperature of the pressure roller 22. A controller 32 is operatively connected to the pressure roller 22, the heater pair 23, the heating span adjuster 29, and the temperature sensor 31. The fixing belt 21 and the components disposed inside the loop formed by the fixing belt 21, that is, the heater pair 23, the nip formation pad 24, the slide member 25, the support 26, the reflector 28, and the heating span adjuster 29, may constitute a belt unit 21U separably coupled with the pressure roller 22.

As a recording medium S bearing a toner image transferred from the transfer belt 5*a* depicted in FIG. 1 is conveyed through the fixing nip N formed between the fixing belt 21 and the pressure roller 22, the fixing belt 21 heated by the heater pair 23 and the pressure roller 22 apply heat and pressure to the recording medium S, thus fixing the toner image on the recording medium S. As the recording medium S bearing the fixed toner image is discharged from the fixing nip N, the recording medium S is separated from the fixing belt 21 and conveyed to the output roller pair 8*b* through the conveyance path R depicted in FIG. 1.

A detailed description is now given of a construction of the fixing belt 21.

The fixing belt 21 is constructed of a base layer 21*a*; an elastic layer 21*b* coating an outer circumferential surface of the base layer 21*a*; and a release layer 21*c* coating an outer circumferential surface of the elastic layer 21*b*. The fixing belt 21 is a flexible belt having a thickness of about 1 mm. A longitudinal direction, that is, an axial direction, of the fixing belt 21 is parallel to a width direction of the recording medium S conveyed over the outer circumferential surface of the fixing belt 21. The fixing belt 21 is formed in a ring having a loop diameter of about 25 mm in cross-section perpendicular to the width direction of the recording medium S.

The base layer 21*a*, having a thickness in a range of from about 20 micrometers to about 100 micrometers, is made of a material having a desired mechanical strength, for example, metal such as nickel and SUS stainless steel and resin such as polyimide. That is, the base layer 21*a* is made of metal or resin film having a decreased thickness.

The elastic layer 21*b*, having a thickness in a range of from about 20 micrometers to about 900 micrometers, is made of rubber such as silicone rubber (Q) and fluoro rubber (FKM). Even if the recording medium S and the fixing belt 21 have surface asperities, as the fixing belt 21 and the pressure roller 22 apply heat and pressure to the recording medium S passing through the fixing nip N, the elastic layer 21*b* of the fixing belt 21 levels pressure exerted onto the recording medium S and heat conducted from the fixing belt 21 to the recording medium S. As the pressure roller 22 and the fixing belt 21 sandwich and press the toner image on the recording medium S passing through the fixing nip N to fix the toner image on the recording medium S, slight surface asperities of the fixing belt 21 may be transferred onto the toner image on the recording medium S, resulting in variation in gloss of the solid toner image that appears as an orange peel image. However, if the elastic layer 21*b* has a thickness not smaller than about 100 micrometers, for example, the elastic layer 21*b* deforms to absorb slight surface asperities to prevent formation of the orange peel image.

The release layer 21*c* is made of a material that facilitates separation of the recording medium S and the toner image formed on the recording medium S from the fixing belt 21. That is, the release layer 21*c* is made of a material that prevents toner of the toner image on the recording medium S from adhering or sticking to the fixing belt 21. Such material does not adhere or stick to a surface of a mold. For example, the release layer 21*c* is made of resin such as tetra fluoro ethylene-perfluoro alkylvinyl ether copolymer (PFA), poly tetra fluoro ethylene (PTFE), poly ether imide (PEI), and poly ether sulphone (PES). The release layer 21*c* has a thickness in a range of from about 1 micrometer to about 200 micrometers.

Alternatively, the fixing belt 21 may not incorporate the elastic layer 21*b*. If the fixing belt 21 does not incorporate the elastic layer 21*b*, the fixing belt 21 has a decreased thermal capacity that enhances heat conduction, saving energy. The loop diameter of the fixing belt 21 is selectively determined within a range of from about 15 mm to about 120 mm according to settings of the fixing device 10.

The fixing belt 21 rotates in the rotation direction B2 in accordance with rotation of the pressure roller 22 rotating in the rotation direction B1. Hence, the fixing belt 21 is driven by the pressure roller 22. The fixing belt 21 and the pressure roller 22, as they rotate, convey the recording medium S entering the fixing nip N in a recording medium conveyance direction B3 and discharge the recording medium S from the fixing nip N.

A detailed description is now given of a construction of the pressure roller 22.

The pressure roller 22 is constructed of a roll 22*a* serving as a core metal; an elastic layer 22*b* coating an outer circumferential surface of the roll 22*a*; and a release layer 22*c* coating an outer circumferential surface of the elastic layer 22*b*. A pressure roller driver 33 depicted in FIG. 3 that is located inside the body 2 of the image forming apparatus 1 depicted in FIG. 1 drives and rotates the pressure roller 22. The pressure roller driver 33 of the pressure roller 22 is constructed of a driving section such as a motor and a reduction section such as a reduction gear. Alternatively, the pressure roller driver 33 may also be connected to the fixing belt 21 to drive and rotate the fixing belt 21. A pressurization assembly presses the pressure roller 22 against the nip formation pad 24 via the fixing belt 21. As the pressure roller 22 is pressed against the nip formation pad 24, the elastic layer 22*b* of the pressure roller 22 is pressed and elastically deformed to define a part of the fixing nip N.

The roll 22*a*, having a desired mechanical strength, is made of metal such as conductive, SC or STKM carbon steel and aluminum (Al) and formed in a solid tube. Alternatively, the roll 22*a* may be formed in a hollow tube inside which a heater such as a halogen heater is situated. Thus, the heater inside the roll 22*a* heats the recording medium S passing through the fixing nip N through the roll 22*a*, the elastic layer 22*b*, and the release layer 22*c* of the pressure roller 22.

Similar to the elastic layer 21*b* of the fixing belt 21, the elastic layer 22*b* of the pressure roller 22 is made of synthetic rubber such as silicone rubber (Q) and fluoro rubber (FKM). The synthetic rubber is relatively rigid, non-foamed solid rubber. If no heater is disposed inside the roll 22*a*, the synthetic rubber may be sponge rubber foam including an elastic foam layer. The sponge rubber, as it contains cells, has an increased insulation that suppresses heat conduction from the fixing belt 21 to the pressure roller 22. That is, the pressure roller 22 does not draw heat from the fixing belt 21, saving energy.

Similar to the release layer 21*c* of the fixing belt 21, the release layer 22*c* of the pressure roller 22 is made of a material that facilitates separation of the recording medium S and the toner image on the recording medium S from the pressure roller 22, enhances durability of the elastic layer 22*b*, and has increased thermal conductivity and durability. For example, the release layer 22*c* is made of PFA or coating of fluoroplastic made of PFA or PTFE or is formed in a silicone rubber layer or a fluoro rubber layer.

A detailed description is now given of a construction of the heater pair 23.

The heater pair 23 includes a center heater 23*a* and a lateral end heater 23*b* that are disposed opposite the inner circumferential surface of the fixing belt 21 and aligned in a circumferential direction of the fixing belt 21. The heater pair 23 is mounted on the body 2 at a position spaced apart from the fixing belt 21. The center heater 23*a* has a center heating span or a center radiation span where the center heater 23*a* heats the fixing belt 21 directly with radiation heat. The center heating span of the center heater 23*a* is disposed opposite a center of the fixing belt 21 in the axial direction thereof where the recording medium S is conveyed. Similar to the center heater 23*a*, the lateral end heater 23*b* has a lateral end heating span or a lateral end radiation span at each lateral end of the heater pair 23 in a longitudinal direction thereof where the lateral end heater 23*b* heats the fixing belt 21 directly with radiation heat. The lateral end heating span of the lateral end heater 23*b* is disposed opposite each lateral end of the fixing belt 21 in the axial direction thereof where the recording medium S is conveyed.

Each of the center heater 23*a* and the lateral end heater 23*b* is a radiant heater. For example, the radiant heater is a halogen heater including a halogen lamp that heats the fixing belt 21 directly, a carbon heater including a quartz tube manufactured by filling inert gas with carbon fiber, a ceramic heater constructed of resistant wiring embedded in ceramic, or the like. The controller 32 (e.g., a processor) controls power supply to the heater pair 23 by turning on and off the heater pair 23.

Alternatively, the heater pair 23 may have a configuration other than that of a heater having a single heating span. For example, the heater pair 23 may be an induction heater that heats the fixing belt 21 by electromagnetic induction.

Figures 4, 5:
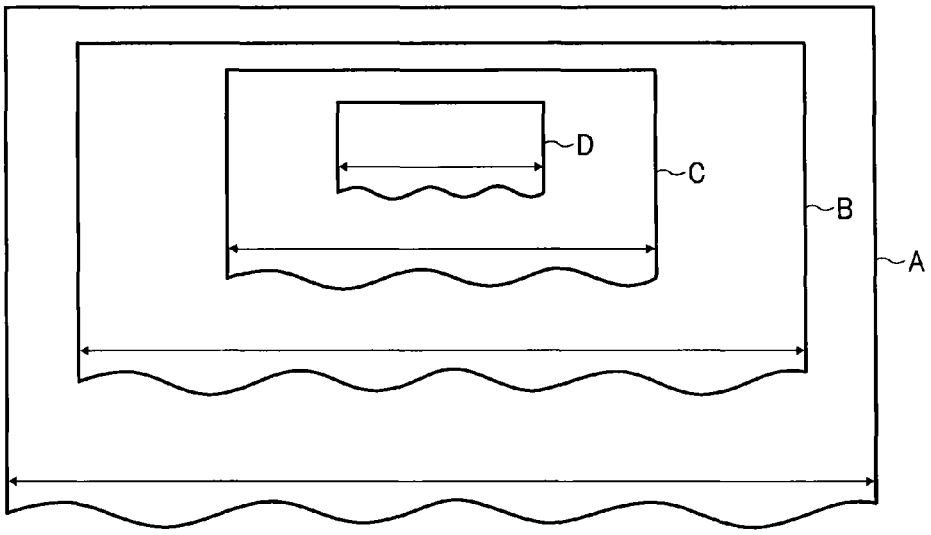
FIG. 4 is a lookup table showing a relation between the size of a recording medium conveyed over a fixing belt, turning on of a center heater and a lateral end heater, and shielding of a heating span adjuster incorporated in the fixing device shown in FIG. 2.
FIG. 5 is a plan view of an extra-large recording medium, a large recording medium, a medium recording medium, and a small recording medium available in the fixing device shown in FIG. 2.

With reference to FIGS. 4 and 5, a description is provided of a relation between turning on of the center heater 23*a* and the lateral end heater 23*b* and the size of recording media.

FIG. 4 is a lookup table showing a relation between the size of a recording medium conveyed over the fixing belt 21, turning on of the center heater 23*a* and the lateral end heater 23*b*, and shielding of the heating span adjuster 29. FIG. 5 is a plan view of an extra-large recording medium A, a large recording medium B, a medium recording medium C, and a small recording medium D. As shown in FIGS. 4 and 5, the controller 32 controls turning on and off of the center heater 23*a* and the lateral end heater 23*b* according to the size of recording media, that is, the extra-large recording medium A, the large recording medium B, the medium recording medium C, and the small recording medium D.

The extra-large recording medium A is an A3 extension size recording medium. The International Standardization Organization Standard (ISO) and the Japanese Industrial Standard (JIS) define that an A3 size recording medium has a length of 420 mm and a width of 297 mm. For example, the A3 extension size recording medium is greater than the A3 size recording medium and has a length of 483 mm and a width of 329 mm. The extra-large recording medium A enters the fixing nip N in an orientation in which the width of 329 mm of the A3 extension size recording medium in a width direction thereof is perpendicular to the recording medium conveyance direction B3. The A3 extension size recording medium greater than the A3 size recording medium is widely used in various printers including photo printers.

The large recording medium B enters the fixing nip N in an orientation in which the width of 297 mm of the A3 size recording medium in portrait orientation in a width direction thereof is perpendicular to the recording medium conveyance direction B3. For example, an A4 size recording medium has a length of 297 mm and a width of 210 mm. Alternatively, the large recording medium B enters the fixing nip N in an orientation in which the length of 297 mm of the A4 size recording medium in landscape orientation in a width direction thereof is perpendicular to the recording medium conveyance direction B3.

The medium recording medium C enters the fixing nip N in an orientation in which the width of 210 mm of the A4 size recording medium in portrait orientation in the width direction thereof is perpendicular to the recording medium conveyance direction B3.

For example, the small recording medium D is a postcard, that is, a Japanese postal card, having a length of 148 mm and a width of 100 mm. The small recording medium D enters the fixing nip N in an orientation in which the width of 100 mm of the postcard in a width direction thereof is perpendicular to the recording medium conveyance direction B3.

As shown in FIG. 4, when the extra-large recording medium A is conveyed through the fixing nip N, the center heater 23*a* and the lateral end heater 23*b* are turned on and the heating span adjuster 29 does not shield the fixing belt 21 from the heater pair 23, thus creating an extra-large axial heating span of the fixing belt 21. Accordingly, the heater pair 23 heats the fixing belt 21 in the extra-large axial heating span throughout the entire width of the fixing belt 21 of about 329 mm.

Figure 6A:
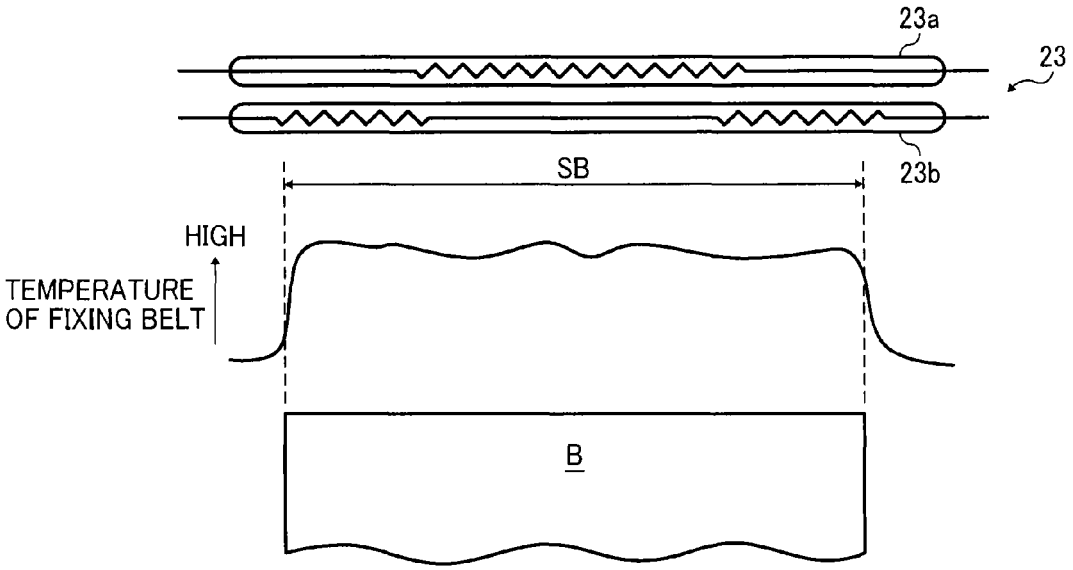
FIG. 6A illustrates a sectional view of the center heater and the lateral end heater that are turned on, temperature distribution of the fixing belt in an axial direction thereof, and a plan view of the large recording medium shown in FIG. 5.

FIG. 6A illustrates a sectional view of the center heater 23*a* and the lateral end heater 23*b* that are turned on, temperature distribution of the fixing belt 21 in the axial direction thereof, and a plan view of the large recording medium B. As shown in FIG. 6A, when the large recording medium B is conveyed through the fixing nip N, the center heater 23*a* and the lateral end heater 23*b* are turned on and the heating span adjuster 29 shields the fixing belt 21 from the heater pair 23, thus creating a large axial heating span SB of the fixing belt 21. Accordingly, the heater pair 23 heats the fixing belt 21 in the large axial heating span SB corresponding to the width of 297 mm of the A3 size recording medium in portrait orientation or the A4 size recording medium in landscape orientation. The heating span adjuster 29 shields the fixing belt 21 from the heater pair 23 at each lateral end of the fixing belt 21 in the axial direction thereof that is outboard from the large axial heating span SB in the axial direction of the fixing belt 21. Accordingly, the temperature of each lateral end of the fixing belt 21 in the axial direction thereof is substantially lower than that of the large axial heating span SB of the fixing belt 21.

Figure 6B:
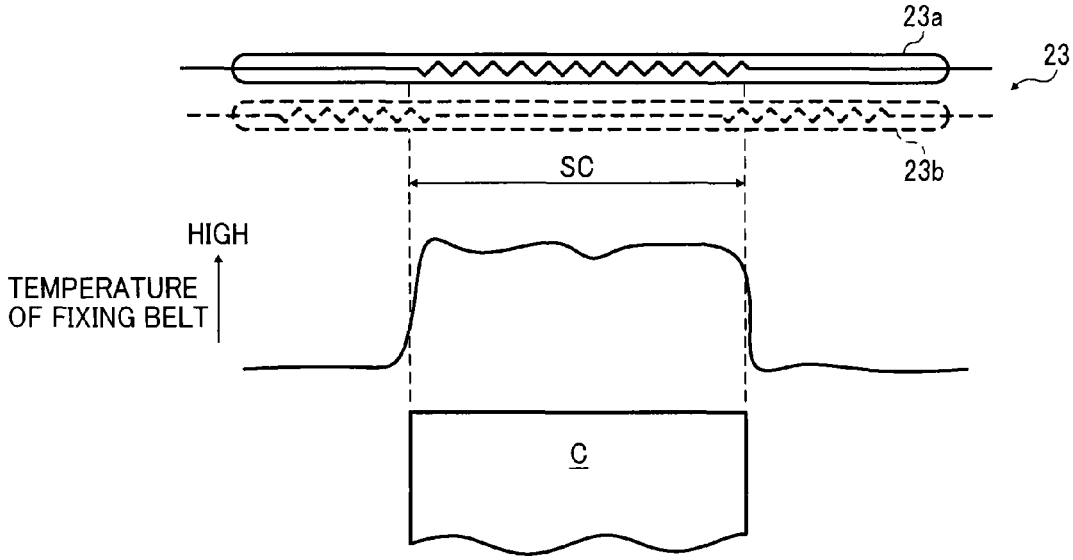
FIG. 6B illustrates a sectional view of the center heater that is turned on, the lateral end heater that is turned off, temperature distribution of the fixing belt in the axial direction thereof, and a plan view of the medium recording medium shown in FIG. 5.

FIG. 6B illustrates a sectional view of the center heater 23*a* that is turned on, the lateral end heater 23*b* that is turned off, temperature distribution of the fixing belt 21 in the axial direction thereof, and a plan view of the medium recording medium C. As shown in FIG. 6B, when the medium recording medium C is conveyed through the fixing nip N, the center heater 23*a* is turned on and the lateral end heater 23*b* is turned off. Accordingly, the heating span adjuster 29 does not shield the fixing belt 21 from the heater pair 23. Consequently, the heater pair 23 heats the fixing belt 21 in a medium axial heating span SC corresponding to the width of 210 mm of the A4 size recording medium in portrait orientation. The heating span adjuster 29 shields the fixing belt 21 from the heater pair 23 at each lateral end of the fixing belt 21 in the axial direction thereof that is outboard from the medium axial heating span SC in the axial direction of the fixing belt 21. Accordingly, the temperature of each lateral end of the fixing belt 21 in the axial direction thereof is substantially lower than that of the medium axial heating span SC of the fixing belt 21.

As shown in FIG. 4, when the small recording medium D is conveyed through the fixing nip N, the center heater 23*a* is turned on and the lateral end heater 23*b* is turned off. The heating span adjuster 29 shields the fixing belt 21 from the heater pair 23, thus creating a small axial heating span of the fixing belt 21. Accordingly, the heater pair 23 heats the fixing belt 21 in the small axial heating span corresponding to the width of 100 mm of the postcard in portrait orientation.

The extra-large recording medium A, the large recording medium B, and the medium recording medium C are defined above according to the size mentioned in column A of the ISO standard or the JIS standard. The small recording medium D is defined above according to the size of Japanese postal card. However, the sizes of the extra-large recording medium A, the large recording medium B, the medium recording medium C, and the small recording medium D are not limited to those described above. For example, the sizes of the extra-large recording medium A, the large recording medium B, the medium recording medium C, and the small recording medium D may be those defined in column B of the JIS standard or columns C and G of the ISO standard or predetermined sizes defined by other standards.

With reference to FIG. 2, a detailed description is now given of a configuration of the nip formation pad 24.

The nip formation pad 24 is made of a rigid material. A longitudinal direction of the nip formation pad 24 is parallel to the width direction of the recording medium S conveyed through the fixing nip N. The nip formation pad 24 is formed in substantially a rectangle in cross-section perpendicular to the width direction of the recording medium S. The nip formation pad 24 disposed inside the loop formed by the fixing belt 21 presses against the pressure roller 22 via the fixing belt 21 to form the fixing nip N between the fixing belt 21 and the pressure roller 22. According to this exemplary embodiment, the fixing nip N is planar in cross-section. Alternatively, the fixing nip N may be concave or curved in cross-section with respect to the pressure roller 22. If the fixing nip N is concave, the concave fixing nip N directs a leading edge of the recording medium S toward the pressure roller 22, facilitating separation of the recording medium S from the fixing nip N and therefore preventing the recording medium S from being jammed between the fixing belt 21 and the pressure roller 22. The slide member 25 adjoins an outer circumferential surface of the nip formation pad 24. The nip formation pad 24 includes a joint 24*a* that adjoins the support 26. Thus, the nip formation pad 24 is mounted on the body 2 of the image forming apparatus 1 depicted in FIG. 1 through the joint 24*a*.

A detailed description is now given of a configuration of the slide member 25.

The slide member 25 is made of a material having an increased mechanical strength in view of resistance to abrasion, heat, friction, and the like. For example, the slide member 25 is made of resin such as PFA and PTFE. The slide member 25 is a sheet having a thickness in a range of from about 50 micrometers to about 2,500 micrometers. The slide member 25 is adhered to the outer circumferential surface of the nip formation pad 24, thus being attached to the nip formation pad 24. Alternatively, the slide member 25 is formed in a film having a predetermined thickness by applying resin such as PFA and PTFE to the outer circumferential surface of the nip formation pad 24.

A detailed description is now given of a configuration of the support 26.

Similar to the nip formation pad 24, a longitudinal direction of the support 26 is parallel to the width direction of the recording medium S. In view of shape, the support 26 includes a bent section disposed opposite the heater pair 23 and bent in cross-section perpendicular to the longitudinal direction of the support 26 and a planar section opposite the bent section and planar in cross-section perpendicular to the longitudinal direction of the support 26. The support 26 is made of metal such as SUS stainless steel, SC or STKM carbon steel, and aluminum. In view of function, the support 26 includes a support portion 26*a* supporting the nip formation pad 24 and a holding portion 26*b* holding the reflector 28. The support portion 26*a* of the support 26 adjoins the joint 24*a* of the nip formation pad 24 to support the nip formation pad 24 against pressure from the pressure roller 22, preventing the nip formation pad 24 from being bent in the width direction of the recording medium S. Thus, the nip formation pad 24 retains the length of the fixing nip N that is even throughout the entire width of the recording medium S. Similar to the nip formation pad 24, the support 26 is situated inside the loop formed by the fixing belt 21 and mounted on the body 2 of the image forming apparatus 1 depicted in FIG. 1.

A detailed description is now given of a configuration of the holder 27.

The holder 27 is situated outside the loop formed by the fixing belt 21 and mounted on the body 2 of the image forming apparatus 1. The holder 27 holds both lateral ends of the support 26 in the longitudinal direction thereof and positions the support 26 with respect to the body 2 of the image forming apparatus 1. Additionally, the holder 27 guides both lateral ends of the fixing belt 21 in the axial direction thereof, preventing the fixing belt 21 from being skewed in the axial direction thereof as the fixing belt 21 rotates.

A detailed description is now given of a construction of the reflector 28.

The reflector 28 is made of an aluminum base and a reflection surface disposed opposite the heater pair 23 and treated with silver (Ag)-vapor deposition. The reflector 28 is constructed of a mounted portion 28*a* mounted on the body 2 of the image forming apparatus 1, a reflection face 28*b*, and a curved face 28*c*. The reflection face 28*b* reflects light emitted from the heater pair 23 thereto toward the inner circumferential surface of the fixing belt 21. The mounted portion 28*a* is disposed at each lateral end of the reflector 28 in a longitudinal direction thereof parallel to the width direction of the recording medium S. Thus, the reflector 28 is mounted on the body 2 of the image forming apparatus 1 at the mounted portions 28*a*. The reflection face 28*b* is interposed between the support 26 and the heater pair 23. The curved face 28*c* is disposed opposite the heater pair 23 and curved to surround the heater pair 23.

The reflector 28 reflects light or heat radiated from the heater pair 23 thereto onto the fixing belt 21 effectively, enhancing heat absorption of the fixing belt 21, suppressing conduction of heat from the heater pair 23 to the support 26, and thereby suppressing waste of energy. Alternatively, instead of the reflector 28, an opposed face of the support 26 disposed opposite the heater pair 23 may be treated with mirror finish to reflect light radiated from the heater pair 23 onto the support 26 toward the fixing belt 21 like the reflector 28. Yet alternatively, an inner circumferential surface of the bent section of the support 26 disposed opposite the heater pair 23 may be made of a heat insulator to insulate the support 26 from the heater pair 23, thus suppressing heat conduction from the heater pair 23 to the support 26.

A detailed description is now given of a configuration of the heating span adjuster 29.

The heating span adjuster 29 is interposed between the heater pair 23 and the fixing belt 21 to shield the fixing belt 21 from radiation heat generated by light from the heater pair 23 according to the size of the recording medium S. That is, the heating span adjuster 29 restricts the axial heating span of the fixing belt 21 heated by the heater pair 23. The heating span adjuster 29 is made of heat resistant metal such as SUS stainless steel, SC or STKM carbon steel, and aluminum. The heating span adjuster 29 includes an opposed face disposed opposite the heater pair 23 that is curved and concave with respect to the heater pair 23 in cross-section perpendicular to the width direction of the recording medium S.

Figure 7:
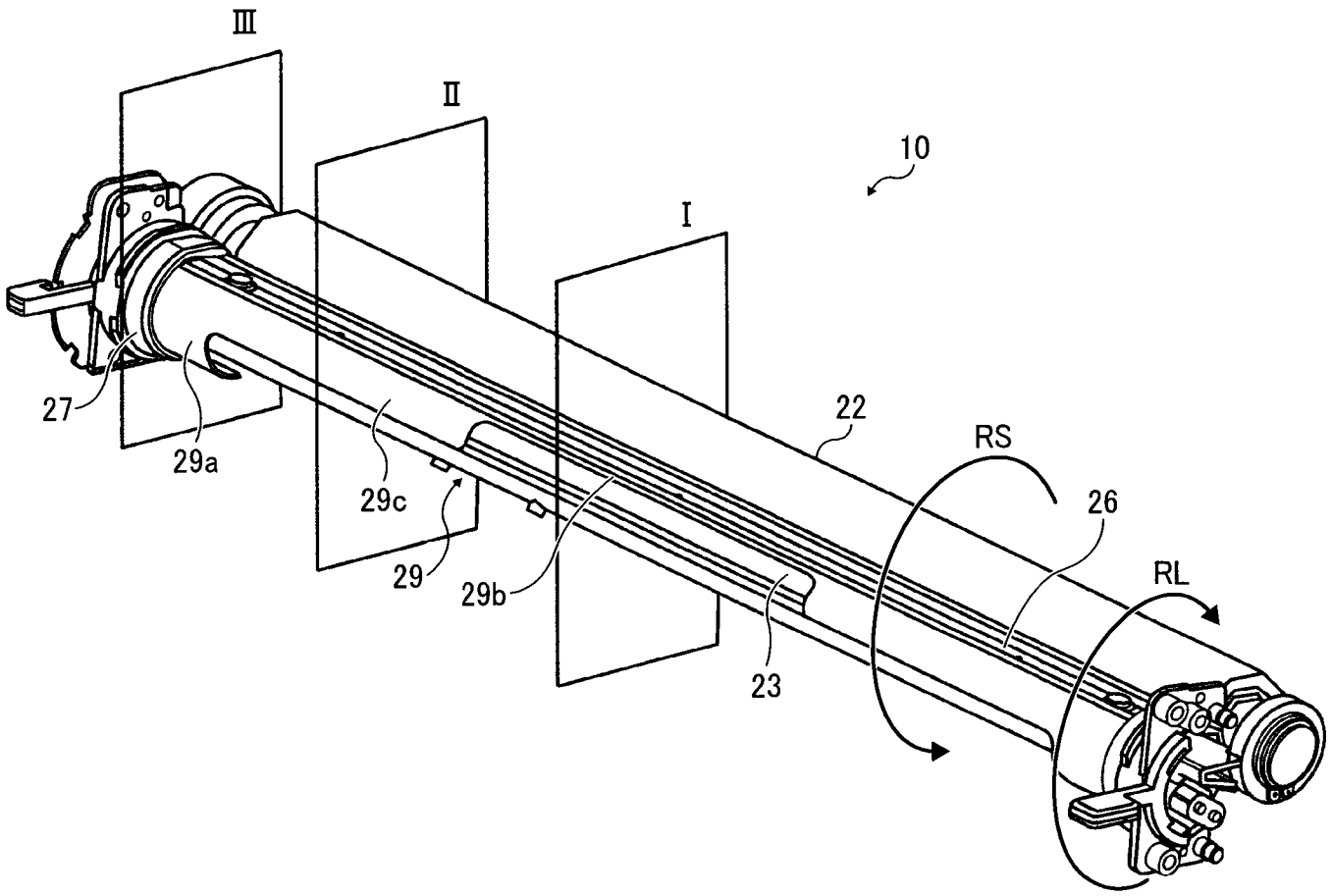
FIG. 7 is a partial perspective view of the fixing device shown in FIG. 2.

FIG. 7 is a partial perspective view of the fixing device 10. As shown in FIG. 7, the heating span adjuster 29 includes two joint portions 29*a* disposed at both lateral ends of the heating span adjuster 29, respectively, in a longitudinal direction thereof parallel to the width direction of the recording medium S; two increased span portions 29*c* disposed inboard from the joint portions 29*a*, respectively, in the longitudinal direction of the heating span adjuster 29; and a decreased span portion 29*b* disposed inboard from the increased span portions 29*c* in the longitudinal direction of the heating span adjuster 29. The joint portions 29*a* are connected to a heating span adjuster driver 34 depicted in FIG. 3 to drive the heating span adjuster 29. The decreased span portion 29*b* spans the width of the small recording medium D (e.g., a postcard) depicted in FIG. 5 to allow the heater pair 23 to heat the fixing belt 21 in a decreased axial heating span thereof. The increased span portions 29*c*, together with the decreased span portion 29*b*, span the width of the large recording medium B (e.g., an A3 size recording medium) depicted in FIG. 5 to allow the heater pair 23 to heat the fixing belt 21 in an increased axial heating span thereof.

The heating span adjuster 29 is installed inside the body 2 of the image forming apparatus 1 depicted in FIG. 1 such that the heating span adjuster 29 is rotatable in the circumferential direction of the fixing belt 21. For example, the heating span adjuster driver 34 drives and rotates the heating span adjuster 29 to change an axial shield span of the fixing belt 21 where the heating span adjuster 29 shields the fixing belt 21 from the heater pair 23 according to the size of the recording medium S conveyed through the fixing nip N. In other words, the heating span adjuster 29 changes an axial heating span of the fixing belt 21 where the heater pair 23 heats the fixing belt 21.

Figure 8:
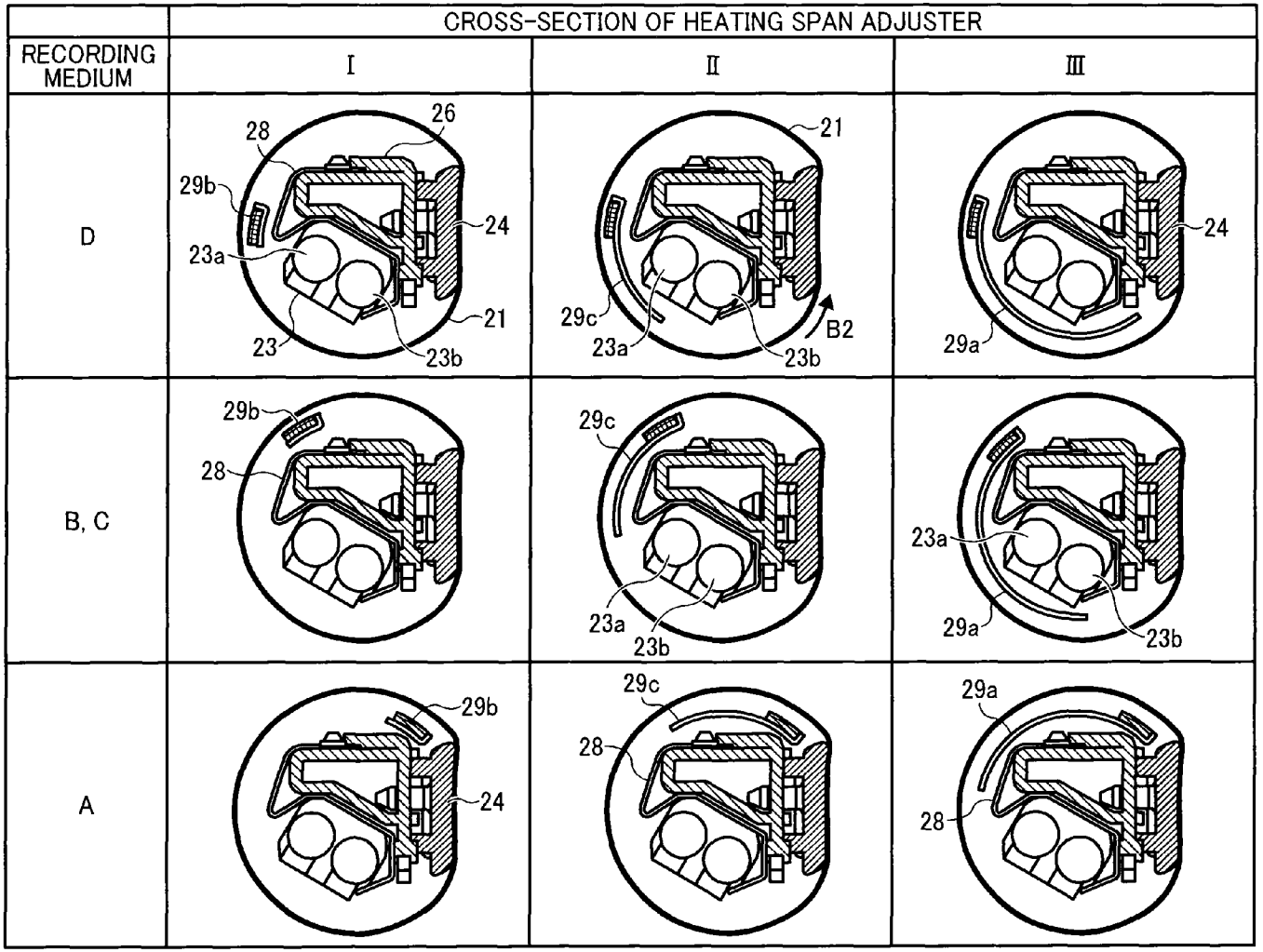
FIG. 8 is a lookup table illustrating the position of a decreased span portion, an increased span portion, and a joint portion of the heating span adjuster incorporated in the fixing device shown in FIG. 2 that corresponds to the size of the recording medium conveyed over the fixing belt.

With reference to FIGS. 7 and 8, a description is provided of a relation between the size of a recording medium conveyed over the fixing belt 21 and the position of the joint portion 29*a*, the increased span portion 29*c*, and the decreased span portion 29*b*.

As shown in FIG. 7, a cross-section I corresponds to a cross-section of the decreased span portion 29*b*. A cross-section II corresponds to a cross-section of the increased span portion 29*c*. A cross-section III corresponds to a cross-section of the joint portion 29*a*. FIG. 8 is a lookup table illustrating the position of the decreased span portion 29*b*, the increased span portion 29*c*, and the joint portion 29*a* that corresponds to the size of the recording medium conveyed over the fixing belt 21. FIG. 8 illustrates the position of the decreased span portion 29*b*, the increased span portion 29*c*, and the joint portion 29*a* when the small recording medium D, the medium recording medium C or the large recording medium B, and the extra-large recording medium A are conveyed over the fixing belt 21. The controller 32 depicted in FIG. 2 rotates the heating span adjuster 29 in rotation directions RL and RS depicted in FIG. 7 to change the axial heating span of the fixing belt 21 where the heater pair 23 heats the fixing belt 21 according to the size of the recording medium S.

For example, as shown in FIG. 8, when the small recording medium D is conveyed over the fixing belt 21, the decreased span portion 29*b* is situated closer to the heater pair 23 compared to when the recording media A to C are conveyed. A leading edge of the increased span portion 29*c* is disposed opposite a gap between the center heater 23*a* and the lateral end heater 23*b* in the rotation direction B2 of the fixing belt 21. A leading edge of the joint portion 29*a* is situated in proximity to the nip formation pad 24. Accordingly, the heating span adjuster 29 produces the decreased axial heating span of the fixing belt 21 where the heater pair 23 heats the fixing belt 21 that corresponds to the width of the small recording medium D. The increased span portions 29*c* shield the fixing belt 21 from the heater pair 23 at both outboard axial spans outboard from the decreased axial heating span in the longitudinal direction of the heating span adjuster 29, thus suppressing overheating of both lateral ends of the fixing belt 21 in the axial direction thereof.

In default mode in which the medium recording medium C and the large recording medium B that are generally used are conveyed over the fixing belt 21, for example, when the medium recording medium C is conveyed over the fixing belt 21, the decreased span portion 29*b* is situated above the reflector 28 in FIG. 8. The leading edge of the increased span portion 29*c* is beside the center heater 23*a* in FIG. 8. The leading edge of the joint portion 29*a* is below the lateral end heater 23*b* in FIG. 8. Accordingly, the heating span adjuster 29 produces a medium axial heating span of the fixing belt 21 where the heater pair 23 heats the fixing belt 21 that corresponds to the width of the medium recording medium C. The joint portions 29*a* shield the fixing belt 21 from the heater pair 23 at both outboard axial spans outboard from the medium axial heating span in the longitudinal direction of the heating span adjuster 29, thus suppressing overheating of both lateral ends of the fixing belt 21 in the axial direction thereof.

When the extra-large recording medium A (e.g., an A3 extension size recording medium) is conveyed over the fixing belt 21, the decreased span portion 29*b* is situated in proximity to the nip formation pad 24. The leading edge of the increased span portion 29*c* is above and in proximity to the reflector 28 in FIG. 8. The leading edge of the joint portion 29*a* is beside the reflector 28 in FIG. 8. Accordingly, the heating span adjuster 29 produces the increased axial heating span of the fixing belt 21 where the heater pair 23 heats the fixing belt 21 that corresponds to the width of the extra-large recording medium A and spans throughout the entire axial span of the fixing belt 21.

The heating span adjuster 29 moves in accordance with the size of the recording medium S to shield the axial span of the fixing belt 21 that is not required to be heated. Accordingly, even if a plurality of small recording media S is conveyed over the fixing belt 21 continuously, a non-conveyance span of the fixing belt 21 where the small recording media S are not conveyed is not heated unnecessarily or does not overheat. Consequently, the controller 32 does not perform unproductive control that may degrade productivity of the fixing device 10 to prevent overheating. Additionally, the number of halogen heaters constituting the heater pair 23 is reduced from three to two, for example, at reduced manufacturing costs, saving energy.

With reference to FIG. 2, a detailed description is now given of a configuration of the temperature sensor 31.

The temperature sensor 31 is mounted on the body 2 of the image forming apparatus 1 depicted in FIG. 1 such that the temperature sensor 31 is situated below the pressure roller 22 in FIG. 2. The temperature sensor 31 is electrically connected to the controller 32. The temperature sensor 31 detects at least one of the temperatures of the fixing belt 21 and the pressure roller 22 and outputs a detection signal to the controller 32.

The temperature sensor 31 is a temperature detection device, for example, a non-contact temperature detection device such as a thermopile that coverts thermal energy into electric energy directly. Alternatively, the temperature sensor 31 may be a contact temperature detection device such as a thermistor including a resistive element that changes electric resistance in accordance with temperature change.

With reference to FIG. 3, a detailed description is now given of a configuration of the controller 32.

The controller 32 includes a micro computer constructed of devices such as a central processing unit (CPU), a read-only memory (ROM), a random access memory (RAM), and an interface circuit. The controller 32 further includes a temperature control section 35, a determination section 36, and a driving motor driver 37 that controls the heating span adjuster driver 34. The controller 32 is operatively connected to the temperature sensor 31 and a paper size detector 38 (e.g., a sensor) that detects the size of an original or a recording medium S.

Alternatively, the controller 32 may include other components to serve as a controller that controls the entire image forming apparatus 1 depicted in FIG. 1. However, FIG. 2 illustrates the controller 32 that controls the heating span adjuster 29 of the fixing device 10.

The temperature control section 35 of the controller 32 controls power supply to the center heater 23*a* and the lateral end heater 23*b*, that is, an electric current and an energization time, thus controlling the heater pair 23 to heat the fixing belt 21 to a desired fixing temperature to fix the toner image on the recording medium S properly or a conveyance temperature at which the toner image is fixed on the recording medium S conveyed through the fixing nip N properly.

The conveyance temperature is determined based on the size of the recording medium S corresponding to the size of the original detected by the paper size detector 38. Data of a relation between the conveyance temperature and the size of the recording medium S is stored in the ROM in advance as a map, for example.

The determination section 36 of the controller 32 determines whether or not to allow conveyance of the recording medium S through the fixing nip N. Determination is performed based on at least one of the temperatures of the fixing belt 21 and the pressure roller 22 detected by the temperature sensor 31 and the conveyance temperature stored in the ROM. For example, the determination section 36 compares the temperature of at least one of the fixing belt 21 and the pressure roller 22 detected by the temperature sensor 31 with the conveyance temperature. If the temperature detected by the temperature sensor 31 is lower than the conveyance temperature, the determination section 36 determines to prohibit conveyance of the recording medium S through the fixing nip N. Conversely, if the temperature detected by the temperature sensor 31 is not lower than the conveyance temperature, the determination section 36 determines to allow conveyance of the recording medium S.

The driving motor driver 37 of the controller 32 controls movement of the heating span adjuster 29 in the rotation directions RL and RS depicted in FIG. 7. The driving motor driver 37 drives a motor of the heating span adjuster driver 34 according to an instruction to move the heating span adjuster 29 to a predetermined position stepwise or at one time.

After the determination section 36 allows conveyance of the recording medium S through the fixing nip N, during a fixing job, the controller 32 moves the heating span adjuster 29 stepwise based on the size of the recording medium S corresponding to the size of the original that is detected by the paper size detector 38 and the temperature of at least one of the fixing belt 21 and the pressure roller 22 that is detected by the temperature sensor 31. Since the controller 32 moves the heating span adjuster 29 stepwise during the fixing job, the heating span adjuster 29 precisely adjusts the axial heating span of the fixing belt 21 where the heater pair 23 heats the fixing belt 21 directly according to the size of the recording medium S and the temperature of at least one of the fixing belt 21 and the pressure roller 22 detected by the temperature sensor 31. Precise adjustment of the axial heating span of the fixing belt 21 suppresses redundant heating of the fixing belt 21 in an unnecessary region thereon, thus reducing load to the fixing belt 21.

With reference to FIG. 1, a brief description is provided of an image forming operation of the image forming apparatus 1 to form a color toner image on a recording medium S.

As a print job starts, a driver drives and rotates the photoconductive drums 4*d* of the sub process units 4Y, 4C, 4M, and 4K, respectively, clockwise in FIG. 1. The charging rollers 4*r* uniformly charge the outer circumferential surface of the respective photoconductive drums 4*d* at a predetermined polarity. The optical writer 3 emits laser beams Lb onto the charged outer circumferential surface of the respective photoconductive drums 4*d* according to yellow, cyan, magenta, and black image data contained in color image data sent from the external device, respectively, thus forming electrostatic latent images thereon. The development devices 4*g* supply yellow, cyan, magenta, and black toners to the electrostatic latent images formed on the photoconductive drums 4*d*, visualizing the electrostatic latent images into yellow, cyan, magenta, and black toner images, respectively.

As a driver drives and rotates the driving roller 5*b* counterclockwise in FIG. 1, the driving roller 5*b* rotates the transfer belt 5*a* counterclockwise in FIG. 1 in the rotation direction A1 by friction therebetween. The power supply applies a constant voltage or a constant current control voltage having a polarity opposite a polarity of the charged toner to the primary transfer rollers 5*d*Y, 5*d*C, 5*d*M, and 5*d*K, creating a transfer electric field at each primary transfer nip formed between the photoconductive drums 4*d* and the primary transfer rollers 5*d*Y, 5*d*C, 5*d*M, and 5*d*K. Accordingly, the yellow, cyan, magenta, and black toner images formed on the photoconductive drums 4*d* are primarily transferred from the photoconductive drums 4*d* onto the transfer belt 5*a* by the transfer electric field created at the primary transfer nips such that the yellow, cyan, magenta, and black toner images are superimposed successively on a same position on the transfer belt 5*a*. Thus, a color toner image is formed on the outer circumferential surface of the transfer belt 5*a*.

After the primary transfer of the yellow, cyan, magenta, and black toner images from the photoconductive drums 4*d* onto the transfer belt 5*a*, the cleaning blades 4*b* remove residual toner failed to be transferred onto the transfer belt 5*a* and therefore remaining on the photoconductive drums 4*d* therefrom. Thereafter, dischargers discharge the outer circumferential surface of the respective photoconductive drums 4*d*, initializing the surface potential thereof and rendering the photoconductive drums 4*d* to be ready for a next print job.

As the development devices 4*g* start supplying yellow, cyan, magenta, and black toners to the electrostatic latent images formed on the photoconductive drums 4*d*, respectively, the feed roller 7*b* situated in the lower portion of the body 2 starts rotation. The feed roller 7*b* picks up and feeds an uppermost recording medium S of a plurality of recording media S loaded on the paper tray 7*a* to the conveyance path R. The registration roller pair 9 conveys the recording medium S sent to the conveyance path R by the feed roller 7*b* to the secondary transfer nip formed between the secondary transfer roller 5*e* and the transfer belt 5*a* at a proper time. The secondary transfer roller 5*e* is applied with a transfer voltage having a polarity opposite a polarity of the color toner image formed on the transfer belt 5*a*, producing a transfer electric field at the secondary transfer nip.

The transfer electric field secondarily transfers the yellow, cyan, magenta, and black toner images constituting the color toner image formed on the transfer belt 5*a* onto the recording medium S collectively. The recording medium S bearing the color toner image is conveyed to the fixing device 10 where the fixing belt 21 and the pressure roller 22 form the fixing nip N. As the recording medium S is conveyed through the fixing nip N, the fixing belt 21 applies heat to the recording medium S and at the same time the pressure roller 22, together with the fixing belt 21, exerts pressure to the recording medium S, melting and fixing the toner image on the recording medium S.

With reference to FIG. 2, a description is provided of a control performed by the controller 32 to control the heating span adjuster 29.

The controller 32 determines whether or not to allow conveyance of the recording medium S to the fixing nip N. After the controller 32 allows conveyance of the recording medium S to the fixing nip N, the recording medium S is conveyed through the fixing nip N. The determination section 36 of the controller 32 determines whether or not to allow conveyance of the recording medium S through the fixing nip N based on the temperature of at least one of the fixing belt 21 and the pressure roller 22 detected by the temperature sensor 31 and the conveyance temperature preset according to the size of the recording medium S.

After the heater pair 23 starts heating the fixing belt 21 until the fixing belt 21 and the pressure roller 22 start conveying the recording medium S through the fixing nip N, the controller 32 moves the heating span adjuster 29 to a retracted position where the heating span adjuster 29 allows the heater pair 23 to heat the fixing belt 21 in the increased axial heating span thereof. When the heating span adjuster 29 is at the retracted position shown in FIG. 2, the heater pair 23 heats the fixing belt 21 directly throughout the entire axial span of the fixing belt 21. That is, the heating span adjuster 29 retracts from a circumferential, direct heating span DH where the heater pair 23 heats the fixing belt 21 directly. Accordingly, the heater pair 23 heats the fixing belt 21 throughout the entire axial span thereof evenly and effectively. Further, the decreased span portion 29*b* of the heating span adjuster 29 is in proximity to the nip formation pad 24, allowing residual heat to be conducted from the decreased span portion 29*b* of the heating span adjuster 29 to the nip formation pad 24 in a direction B4.

After the recording medium S is conveyed toward the fixing device 10 and the controller 32 allows conveyance of the recording medium S to the fixing nip N, the heating span adjuster 29 moves to a desired shield position according to the size of the recording medium S. The heating span adjuster 29 at the desired shield position shields the fixing belt 21 from the heater pair 23 in a non-conveyance span where the recording medium S is not conveyed over the fixing belt 21. Conversely, in a conveyance span where the recording medium S is conveyed over the fixing belt 21, the heating span adjuster 29 allows the heater pair 23 to heat the fixing belt 21 directly.

During the fixing job in which the fixing belt 21 heats the recording medium S, the controller 32 moves the heating span adjuster 29 stepwise based on the size of the recording medium S and the temperature of at least one of the fixing belt 21 and the pressure roller 22 detected by the temperature sensor 31.

The recording medium S bearing the toner image fixed on thereon at the fixing nip N is separated from the fixing belt 21 by a separator. Thereafter, the recording medium S bearing the fixed toner image is discharged onto the output tray 8*a* of the output device 8 by the output roller pair 8*b* depicted in FIG. 1. After the secondary transfer of the color toner image from the transfer belt 5*a* onto the recording medium S, the belt cleaner 6 removes residual toner failed to be transferred onto the recording medium S and therefore remaining on the transfer belt 5*a* therefrom. The removed toner is conveyed and collected into the waste toner container.

The above describes the image forming operation of the image forming apparatus 1 to form the color toner image on the recording medium S. Alternatively, the image forming apparatus 1 may form a monochrome toner image by using any one of the four sub process units 4Y, 4C, 4M, and 4K or may form a bicolor or tricolor toner image by using two or three of the sub process units 4Y, 4C, 4M, and 4K.

A description is provided of advantages of the fixing device 10 described above.

As shown in FIG. 2, the fixing device 10 includes the fixing belt 21, the pressure roller 22, the heater pair 23, the nip formation pad 24, and the heating span adjuster 29 movable to change the axial heating span of the fixing belt 21 where the heater pair 23 heats the fixing belt 21. After the heater pair 23 starts heating the fixing belt 21 until the fixing belt 21 and the pressure roller 22 start conveying the recording medium S through the fixing nip N, the heating span adjuster 29 is at the retracted position where the heating span adjuster 29 allows the heater pair 23 to heat the fixing belt 21 in the increased axial heating span of the fixing belt 21. When the heating span adjuster 29 is at the retracted position, the heating span adjuster 29 is outboard from the circumferential, direct heating span DH of the fixing belt 21 where the heater pair 23 heats the fixing belt 21 directly.

For example, the fixing device 10 includes the fixing belt 21 serving as a fixing rotator rotatable to fix the toner image on the recording medium S; the heater pair 23 serving as a heater to heat the fixing belt 21; the pressure roller 22 serving as a pressing rotator disposed opposite the outer circumferential surface of the fixing belt 21; the nip formation pad 24, disposed opposite the inner circumferential surface of the fixing belt 21, to press against the pressure roller 22 via the fixing belt 21 to form the fixing nip N between the fixing belt 21 and the pressure roller 22; and the heating span adjuster 29 interposed between the heater pair 23 and the fixing belt 21 and movable to change the axial heating span of the fixing belt 21 where the heater pair 23 heats the fixing belt 21. After the heater pair 23 starts heating the fixing belt 21 until the fixing belt 21 and the pressure roller 22 start conveying the recording medium S through the fixing nip N, the heating span adjuster 29 moves to the retracted position where the heating span adjuster 29 allows the heater pair 23 to heat the fixing belt 21 in the increased axial heating span of the fixing belt 21. When the heating span adjuster 29 is at the retracted position, the heating span adjuster 29 is outboard from the circumferential, direct heating span DH of the fixing belt 21 where the heater pair 23 heats the fixing belt 21 directly.

Accordingly, the heater pair 23 heats the fixing belt 21 evenly, saving energy and shortening a first print time taken to output the recording medium S bearing the fixed toner image onto the output tray 8*a* after the image forming apparatus 1 receives a print job.

After the heater pair 23 starts heating the fixing belt 21 until the fixing belt 21 and the pressure roller 22 start conveying the recording medium S through the fixing nip N, the heating span adjuster 29 moves to the retracted position where the heating span adjuster 29 allows the heater pair 23 to heat the fixing belt 21 in the increased axial heating span thereof. Since the heating span adjuster 29 at the retracted position does not shield the fixing belt 21 from the heater pair 23, the heater pair 23 directly heats the fixing belt 21 effectively and evenly throughout the entire axial span of the fixing belt 21. Accordingly, the heater pair 23 heats the fixing belt 21 with reduced power consumption, facilitating energy saving. As shown in FIG. 2, since the decreased span portion 29*b* of the heating span adjuster 29 is disposed closer to the nip formation pad 24 than the increased span portions 29*c* and the joint portions 29*a* of the heating span adjuster 29 depicted in FIG. 7, residual heat is conducted from the decreased span portion 29*b* to the nip formation pad 24, thus heating the nip formation pad 24. That is, residual heat of the heating span adjuster 29 is used to heat the fixing belt 21 through the nip formation pad 24, saving energy. Accordingly, the heating span adjuster 29 facilitates heating of the fixing belt 21 throughout the entire fixing nip N, heating the fixing belt 21 and the nip formation pad 24 quickly upon receipt of a next fixing job and shortening the first print time.

Figure 9:
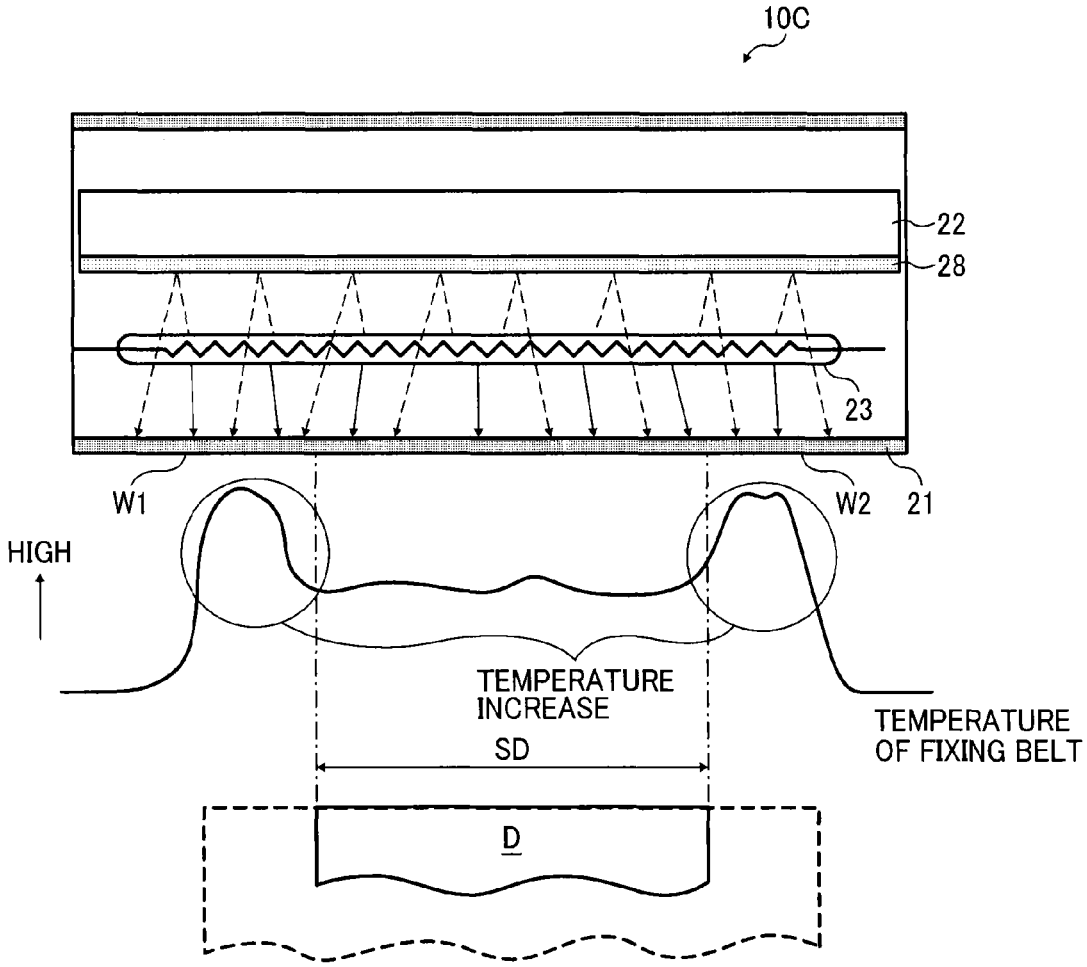
FIG. 9 illustrates a sectional view of a comparative fixing device and temperature distribution of the fixing belt incorporated therein in the axial direction of the fixing belt as the small recording medium shown in FIG. 5 is conveyed over the fixing belt.

Further, the fixing device 10 incorporating the heating span adjuster 29 achieves advantages below. If the fixing device 10 does not incorporate the heating span adjuster 29, the fixing belt 21 may overheat partially, resulting in thermal degradation of the fixing belt 21. FIG. 9 illustrates a sectional view of a comparative fixing device 10C and temperature distribution of the fixing belt 21 in the axial direction thereof as the small recording medium D is conveyed over the fixing belt 21. As shown in FIG. 9, the fixing belt 21 is heated directly by the heater pair 23 with light, indicated by the solid line, that is emitted from the heater pair 23 onto the fixing belt 21 and indirectly by the heater pair 23 with light, indicated by the dotted line, that is emitted from the heater pair 23 onto the reflector 28 and reflected by the reflector 28 onto the fixing belt 21. As the small recording medium D is conveyed through the fixing nip N formed between the fixing belt 21 and the pressure roller 22, the small recording medium D is not conveyed over both lateral ends W1 and W2 of the fixing belt 21 in the axial direction thereof and therefore does not draw heat from both lateral ends W1 and W2 of the fixing belt 21. Accordingly, the temperature of both lateral ends W1 and W2 of the fixing belt 21 indicated by the solid circles increases to a temperature substantially greater than the temperature of an axial span SD of the fixing belt 21 corresponding to the width of the small recording medium D. Since the small recording medium D is conveyed over the fixing belt 21 in the axial span SD thereof, the small recording medium D draws heat from the fixing belt 21 in the axial span SD thereof. Accordingly, the fixing belt 21 is immune from overheating in the axial span SD thereof. Conversely, the small recording medium D does not draw heat from the fixing belt 21 in both lateral ends W1 and W2 thereof, resulting in overheating of both lateral ends W1 and W2 of the fixing belt 21.

To address this circumstance, the fixing device 10 includes the heating span adjuster 29 that moves according to the size of the small recording medium D, allowing the heater pair 23 to heat the fixing belt 21 in the axial span SD where the small recording medium D is conveyed. Accordingly, the temperature of both lateral ends W1 and W2 of the fixing belt 21 is suppressed to a temperature equivalent to the temperature of the axial span SD of the fixing belt 21 where the small recording medium D is conveyed, thus suppressing overheating of both lateral ends W1 and W2 of the fixing belt 21.

As shown in FIG. 2, the heater pair 23 is constructed of two heaters, that is, the center heater 23*a* and the lateral end heater 23*b*. Accordingly, as shown in FIG. 4, when the recording medium B having an increased width, for example, the A3 size recording medium in portrait orientation, is conveyed over the fixing belt 21, the center heater 23*a* and the lateral end heater 23*b* are turned on. Conversely, when the recording medium C having a decreased width, for example, the A4 size recording medium in portrait orientation, is conveyed over the fixing belt 21, the center heater 23*a* is turned on. Consequently, power consumed by the heater pair 23 is reduced, saving energy.

As the controller 32 determines the size of the recording medium S to be conveyed through the fixing nip N, the controller 32 controls turning on and off of the center heater 23*a* and the lateral end heater 23*b* and shielding of the heating span adjuster 29. Immediately after the image forming apparatus 1 is powered on, it is necessary to warm up peripheral components surrounding the fixing nip N before the controller 32 determines the size of the recording medium S so as to render the peripheral components to store heat for a fixing job.

Since the fixing belt 21 is relatively thin and has a decreased thermal capacity, the fixing belt 21 is heated quickly by the heater pair 23 at a position in proximity to the heater pair 23. However, when the peripheral components have a decreased temperature, the fixing belt 21 is cooled quickly as it passes through the fixing nip N. Accordingly, the fixing belt 21 may not melt toner of the toner image on the recording medium S sufficiently, forming an offset image. To address this circumstance, it is necessary to heat the nip formation pad 24 and the pressure roller 22 that constitute the peripheral components to a predetermined temperature or higher.

Accordingly, the controller 32 prohibits conveyance of the recording medium S through the fixing N until the nip formation pad 24 and the pressure roller 22 are heated to the predetermined temperature or higher. Since the controller 32 allows conveyance of the recording medium S through the fixing nip N when the nip formation pad 24 and the pressure roller 22 are heated to the predetermined temperature or higher, if the nip formation pad 24 and the pressure roller 22 are heated to the predetermined temperature or higher quickly after the image forming apparatus 1 is powered on, the fixing device 10 shortens the first print time.

Before the controller 32 determines the size of the recording medium S, it is necessary to heat the peripheral components to the predetermined temperature or higher throughout the entire width of the recording medium S to prevent formation of an offset image even when any size of the recording medium S is to be conveyed through the fixing nip N. Both lateral ends of the pressure roller 22 in an axial direction thereof are supported by the cabinet of the body 2 through bearings or the like such that the pressure roller 22 is rotatable. Accordingly, both lateral ends of the pressure roller 22 in the axial direction thereof are susceptible to heat conduction to the cabinet of the body 2 relative to a center of the pressure roller 22 in the axial direction thereof and therefore are heated slowly. To address this circumstance, it is important to heat both lateral ends of the pressure roller 22 in the axial direction thereof quickly to shorten the first print time.

According to this exemplary embodiment, the center heater 23*a* and the lateral end heater 23*b* are turned on and the heating span adjuster 29 is at the retracted position where the heating span adjuster 29 allows the heater pair 23 to heat the fixing belt 21 in the increased axial heating span until the controller 32 allows conveyance of the recording medium S through the fixing nip N after the image forming apparatus 1 is powered on. Further, when the heating span adjuster 29 is at the retracted position to produce the increased axial heating span of the fixing belt 21 as shown in FIG. 2, the heating span adjuster 29 is behind the reflector 28 to escape light from the heater pair 23. For example, at the retracted position, both lateral ends of the heating span adjuster 29 in the longitudinal direction thereof are immune from direct irradiation of light from the heater pair 23 and situated outboard from the circumferential direct heating span DH.

Accordingly, when the heating span adjuster 29 is at the retracted position, the heating span adjuster 29 allows the heater pair 23 to heat the fixing belt 21 directly throughout the entire axial span of the fixing belt 21. The fixing belt 21 heats the fixing nip N throughout the entire axial span thereof, preventing formation of an offset image even if a first recording medium of a print job is an extra-large recording medium A having a width equivalent to the increased axial heating span of the fixing belt 21, thus shortening the first print time.

The controller 32 determines whether or not to convey the recording medium S through the fixing nip N based on the temperature of at least one of the fixing belt 21 and the pressure roller 22 detected by the temperature sensor 31 and the conveyance temperature preset according to the size of the recording medium S, achieving precise determination, energy saving, and shortage of the first print time.

After the controller 32 allows conveyance of the recording medium S through the fixing nip N, the controller 32 moves the heating span adjuster 29 to a predetermined position corresponding to the size of the recording medium S, achieving advantages below. The controller 32 allows the heater pair 23 to heat the fixing belt 21 directly in a proper axial heating span corresponding to the size of the recording medium S, preventing overheating of both lateral ends W1 and W2 of the fixing belt 21 shown in FIG. 9, saving energy and shortening the first print time.

While the fixing belt 21 performs a fixing job, the controller 32 moves the heating span adjuster 29 stepwise based on the size of the recording medium S and the temperature detected by the temperature sensor 31, achieving advantages below.

Stepwise movement of the heating span adjuster 29 precisely changes the area of the fixing belt 21 heated by the heater pair 23 directly based on the size of the recording medium S and the temperature detected by the temperature sensor 31. Accordingly, the heating span adjuster 29 suppresses unnecessary heating of an unnecessary region of the fixing belt 21, reducing load imposed on the fixing belt 21, saving energy, and shortening the first print time precisely.

The image forming apparatus 1 depicted in FIG. 1, as it incorporates the fixing device 10 including the fixing belt 21 heated evenly throughout the entire axial span thereof, facilitates energy saving and shortens the first print time. The fixing device 10 improves its fixing property of heating the fixing belt 21 quickly for a next fixing job and prevents formation of a faulty toner image such as an offset image. Accordingly, the fixing device 10 fixes the toner image on the recording medium S properly and the image forming apparatus 1 incorporating the fixing device 10 forms the high quality toner image on the recording medium S.

Figure 10:
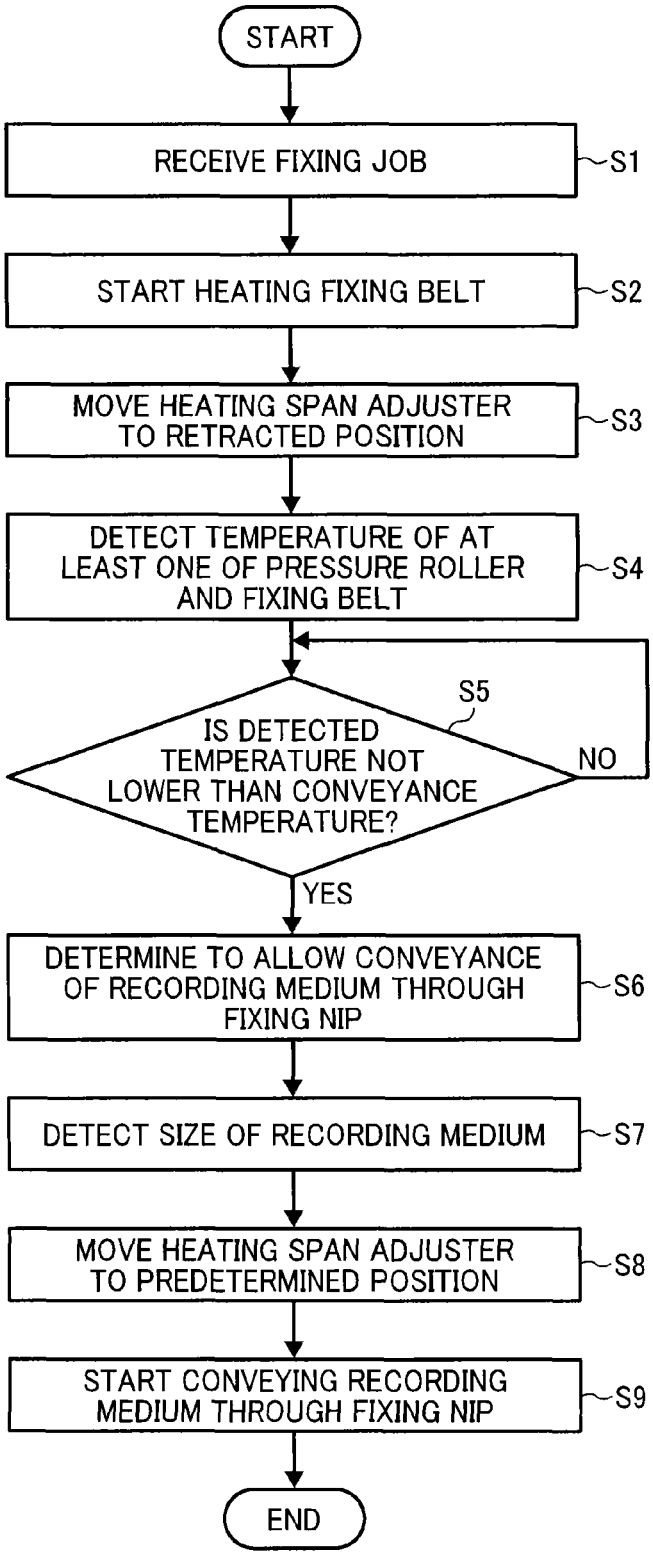
FIG. 10 is a flowchart showing control processes performed by a controller incorporated in the image forming apparatus shown in FIG. 1.

With reference to FIG. 10, a description is provided of control processes performed by the controller 32 depicted in FIG. 2 to achieve the advantages described above.

FIG. 10 is a flowchart showing the control processes performed by the controller 32. As shown in FIG. 10, in step S1, the controller 32 receives a fixing job. In step S2, the controller 32 controls the heater pair 23 to start heating the fixing belt 21. In step S3, the controller 32 moves the heating span adjuster 29 to the retracted position shown in FIG. 2. Alternatively, if the heating span adjuster 29 is already at the retracted position, it is not necessary to move the heating span adjuster 29 in step S3. In step S4, the controller 32 detects the temperature of at least one of the pressure roller 22 and the fixing belt 21 detected by the temperature sensor 31. In step S5, the controller 32 compares the temperature detected by the temperature sensor 31 with the preset conveyance temperature. If the controller 32 determines that the temperature detected by the temperature sensor 31 is not lower than the preset conveyance temperature (YES in step S5), the controller 32 determines to allow conveyance of the recording medium S through the fixing nip N in step S6. In step S7, the controller 32 detects the size of the recording medium S. Alternatively, if the paper size detector 38 is disposed in proximity to the fixing nip N, the controller 32 may perform steps S6 and S7 simultaneously. In step S8, the controller 32 moves the heating span adjuster 29 to a predetermined shield position corresponding to the detected size of the recording medium S. In step S9, the controller 32 controls the fixing belt 21 and the pressure roller 22 to start conveying the recording medium S through the fixing nip N.

As shown in FIG. 2, the heater pair 23 serving as a heater for heating the fixing belt 21 is constructed of two heaters, that is, the center heater 23*a* and the lateral end heater 23*b*. Alternatively, the fixing device 10 may incorporate a single heater or three or more heaters.

As shown in FIG. 7, the joint portion 29*a* and the increased span portion 29*c* are disposed at each lateral end of the heating span adjuster 29 in the longitudinal direction thereof. Alternatively, the joint portion 29*a* and the increased span portion 29*c* may be disposed at one lateral end of the heating span adjuster 29 in the longitudinal direction thereof. In this case, the recording medium S is conveyed over the fixing belt 21 along one lateral edge of the fixing belt 21 in the axial direction thereof and the joint portion 29*a* and the increased span portion 29*c* are disposed in proximity to another lateral edge of the fixing belt 21 in the axial direction thereof.

According to the exemplary embodiments described above, the fixing belt 21 serves as a fixing rotator. Alternatively, a fixing film, a fixing roller, or the like may be used as a fixing rotator. Further, the pressure roller 22 serves as a pressing rotator. Alternatively, a pressure belt or the like may be used as a pressing rotator.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a fixing rotator rotatable in a predetermined direction of rotation;

a heater disposed opposite the fixing rotator to heat the fixing rotator;

a pressing rotator to press against the fixing rotator to form a fixing nip therebetween, the fixing nip through which a recording medium is conveyed; and a heating span adjuster interposed between the heater and the fixing rotator and movable in a circumferential direction of the fixing rotator to change an axial heating span of the fixing rotator where the heater heats the fixing rotator, the heating span adjuster to move to a retracted position where the heating span adjuster allows the heater to heat the fixing rotator in an increased axial heating span of the fixing rotator after the heater starts heating the fixing rotator until the fixing rotator and the pressing rotator start conveying the recording medium through the fixing nip, the retracted position where the heating span adjuster is outboard from a circumferential, direct heating span of the fixing rotator where the heater heats the fixing rotator directly.

2. The fixing device according to claim 1, further comprising a reflector disposed opposite the heater to reflect light radiated from the heater thereto toward the fixing rotator, the reflector defining the circumferential, direct heating span of the fixing rotator.

3. The fixing device according to claim 2, wherein the reflector is interposed between the heater and the heating span adjuster when the heating span adjuster is at the retracted position.

4. The fixing device according to claim 1, wherein the heating span adjuster includes:

a decreased span portion to produce a decreased axial heating span of the fixing rotator where the heater heats the fixing rotator, the decreased axial heating span corresponding to a width of a small recording medium in an axial direction of the fixing rotator; and an increased span portion, together with the decreased span portion, to produce an increased axial heating span of the fixing rotator where the heater heats the fixing rotator, the increased axial heating span corresponding to a width of a great recording medium in the axial direction of the fixing rotator.

5. The fixing device according to claim 4, further comprising a nip formation pad disposed opposite the pressing rotator via the fixing rotator to form the fixing nip between the fixing rotator and the pressing rotator.

6. The fixing device according to claim 5, wherein the decreased span portion of the heating span adjuster is in proximity to the nip formation pad when the heating span adjuster is at the retracted position.

7. The fixing device according to claim 1, wherein the fixing rotator includes a fixing belt.

8. The fixing device according to claim 1, wherein the pressing rotator includes a pressure roller.

9. An image forming apparatus comprising:

an image forming device to form a toner image;

a fixing device to fix the toner image formed by the image forming device on a recording medium, the fixing device including:

a fixing rotator rotatable in a predetermined direction of rotation;

a heater disposed opposite the fixing rotator to heat the fixing rotator;

a pressing rotator to press against the fixing rotator to form a fixing nip therebetween, the fixing nip through which the recording medium is conveyed; and a heating span adjuster interposed between the heater and the fixing rotator and movable in a circumferential direction of the fixing rotator to change an axial heating span of the fixing rotator where the heater heats the fixing rotator; and a controller operatively connected to the heating span adjuster to move the heating span adjuster to a retracted position where the heating span adjuster allows the heater to heat the fixing rotator in an increased axial heating span of the fixing rotator after the heater starts heating the fixing rotator until the fixing rotator and the pressing rotator start conveying the recording medium through the fixing nip, the retracted position where the heating span adjuster is outboard from a circumferential, direct heating span of the fixing rotator where the heater heats the fixing rotator directly.

10. The image forming apparatus according to claim 9, wherein the fixing device further includes a temperature sensor operatively connected to the controller and disposed opposite at least one of the fixing rotator and the pressing rotator to detect a temperature of the at least one of the fixing rotator and the pressing rotator, and wherein the controller allows conveyance of the recording medium through the fixing nip when the controller determines that the temperature detected by the temperature sensor reaches a preset conveyance temperature.

11. The image forming apparatus according to claim 10, wherein the preset conveyance temperature is determined based on a size of the recording medium.

12. The image forming apparatus according to claim 11, wherein the controller moves the heating span adjuster to a predetermined position determined based on the size of the recording medium after the controller allows conveyance of the recording medium through the fixing nip.

13. The image forming apparatus according to claim 12, wherein the controller moves the heating span adjuster stepwise based on the size of the recording medium and the temperature detected by the temperature sensor during a fixing job.

14. A fixing method for fixing a toner image on a recording medium conveyed through a fixing nip formed between a fixing rotator and a pressing rotator, the fixing method comprising:

receiving a fixing job;

starting heating the fixing rotator with a heater;

moving a heating span adjuster to a retracted position where the heating span adjuster allows the heater to heat the fixing rotator in an increased axial heating span of the fixing rotator;

detecting a temperature of at least one of the pressing rotator and the fixing rotator;

determining that the detected temperature is not lower than a preset conveyance temperature;

determining to allow conveyance of the recording medium through the fixing nip;

detecting a size of the recording medium;

moving the heating span adjuster to a predetermined position corresponding to the detected size of the recording medium; and starting conveying the recording medium through the fixing nip.

* * * * *